US011449087B1

(12) United States Patent
Gupta

(10) Patent No.: US 11,449,087 B1
(45) Date of Patent: Sep. 20, 2022

(54) START-UP CIRCUIT FOR SELF-BIASED CIRCUIT

(71) Applicant: NXP B.V., San Jose, CA (US)

(72) Inventor: Sushil Kumar Gupta, Bangalore (IN)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 17/454,646

(22) Filed: Nov. 12, 2021

(51) Int. Cl.
*G05F 3/30* (2006.01)
*G05F 3/26* (2006.01)

(52) U.S. Cl.
CPC ..... *G05F 3/262* (2013.01)

(58) Field of Classification Search
None
See application file for complete search history.

(56) References Cited

U.S. PATENT DOCUMENTS

| | | | | |
|---|---|---|---|---|
| 7,268,529 | B2 * | 9/2007 | Mochizuki | G05F 3/30 323/314 |
| 7,755,419 | B2 | 7/2010 | Rao et al. | |
| 8,030,979 | B2 * | 10/2011 | Yoo | G05F 3/30 327/143 |
| 8,400,124 | B2 | 3/2013 | Stellberger et al. | |
| 9,110,486 | B2 | 8/2015 | Siegel et al. | |
| 10,061,340 | B1 * | 8/2018 | Rao | G05F 3/267 |

OTHER PUBLICATIONS

Akshaya, R., et al., "Analysis and Design of Bandgap Reference (BGR)", Proceeding of the Second International Conference on Microelectronics & Communication Systems (MCCS 2017), pp. 413-450, Springer, Singapore, Jul. 31, 2018.
Banba, H., et al., "A CMOS bandgap reference circuit with sub-1-V operation", IEEE Journal of Solid-State Circuits, pp. 670-674, vol. 34, Issue. 5, IEEE May 1999.
Cao, T., et al., "Novel Start-Up Circuit With Enhanced Power-Up Characteristic for Bandgap References", 2008 IEEE International SOC Conference, Oct. 10, 2008.
Feng, C., et al., "CMOS 1.2V bandgap voltage reference design", 2013 IEEE 10th International Conference on ASIC, , IEEE, Shenzhen, China, Oct. 28-31, 2013.
Hassan, A., et al., "A Low-Power Self-Startup Bandgap Circuit for Energy Efficient Applications", 2017 New Generation of CAS (NGCAS), IEEE, Genova, Italy, Sep. 6-9, 2017.
(Continued)

*Primary Examiner* — Jeffery S Zweizig

(57) ABSTRACT

An integrated circuit (IC) includes a self-biased circuit and a start-up circuit for the self-biased circuit. The self-biased circuit generates a start-up indicator signal and an output signal. The start-up indicator signal indicates whether the self-biased circuit has started up. The start-up circuit includes a comparator, a start-up controller, and a peak controller. The comparator compares the start-up indicator signal with a reference signal generated based on supply voltages, and generates a comparison signal. The start-up controller controls a start-up of the self-biased circuit when the comparison signal is at a first logic state. Further, when the comparison signal transitions from the first logic state to a second logic state, the peak controller controls the output signal to maintain one of a voltage level and a current level of the output signal below a peak limit.

20 Claims, 7 Drawing Sheets

(56) References Cited

OTHER PUBLICATIONS

Kim, I., et al., "Current Source & Bias Circuits", http://www.cse.psu.edu/~kxc104/class/cse577/11s/lec/S05BiasCkt.pdf, Feb. 22, 2011.
Pan, M., et al., "A 0.7 V 5 nW CMOS sub-bandgap voltage reference without resistors", Analog Integrated Circuits and Signal Processing, pp. 71-79, Springer, May 10, 2020.
Salehi, M., et al., "A 1.58 nW power consumption and 34.45 ppm/° C. temperature coefficient bandgap reference (BGR) for subblocks of RFID tag", Microelectronics Journal, pp. 383-389, vol. 46, Issue. 5, Elsevier, May 2015.
Sobhi, J., et al., "Design of a programmable bandgap reference circuit", 2009 4th IEEE Conference on Industrial Electronics and Applications, IEEE, Xi'an, China, May 25-27, 2009.
Traversi, G., et al., "Design of bandgap reference circuits in a 65 nm CMOS technology for HL-LHC applications", Topical Workshop on Electronics for Particle Physics, Aix en Provence, France, Sep. 22-26, 2014.
Traversi, G., et al., "Characterization of bandgap reference circuits designed for high energy physics applications", Nuclear Instruments and Methods in Physics Research Section A: Accelerators, Spectrometers, Detectors and Associated Equipment, pp. 371-373, vol. 824, Elsevier, Jul. 11, 2016.
Yu, C., et al., "An Area-Efficient Current-Mode Bandgap Reference With Intrinsic Robust Start-Up Behavior", IEEE Transactions on Circuits and Systems II: Express Briefs, pp. 937-941, vol. 62, Issue. 10, IEEE, Jul. 17, 2015.

* cited by examiner

START-UP CIRCUIT FOR SELF-BIASED CIRCUIT

BACKGROUND

The present disclosure relates generally to electronic circuits, and, more particularly, to a start-up circuit for a self-biased circuit.

Self-biased circuits, such as voltage reference circuits, current reference circuits, or the like, are widely used in an integrated circuit (IC) to provide a voltage or a current of a specified value to various functional circuits of the IC. However, such self-biased circuits may fail to start, thereby leading to an operational failure of the IC.

BRIEF DESCRIPTION OF THE DRAWINGS

The following detailed description of the preferred embodiments of the present disclosure will be better understood when read in conjunction with the appended drawings. The present disclosure is illustrated by way of example, and not limited by the accompanying figures, in which like references indicate similar elements.

DETAILED DESCRIPTION

Figure 1:
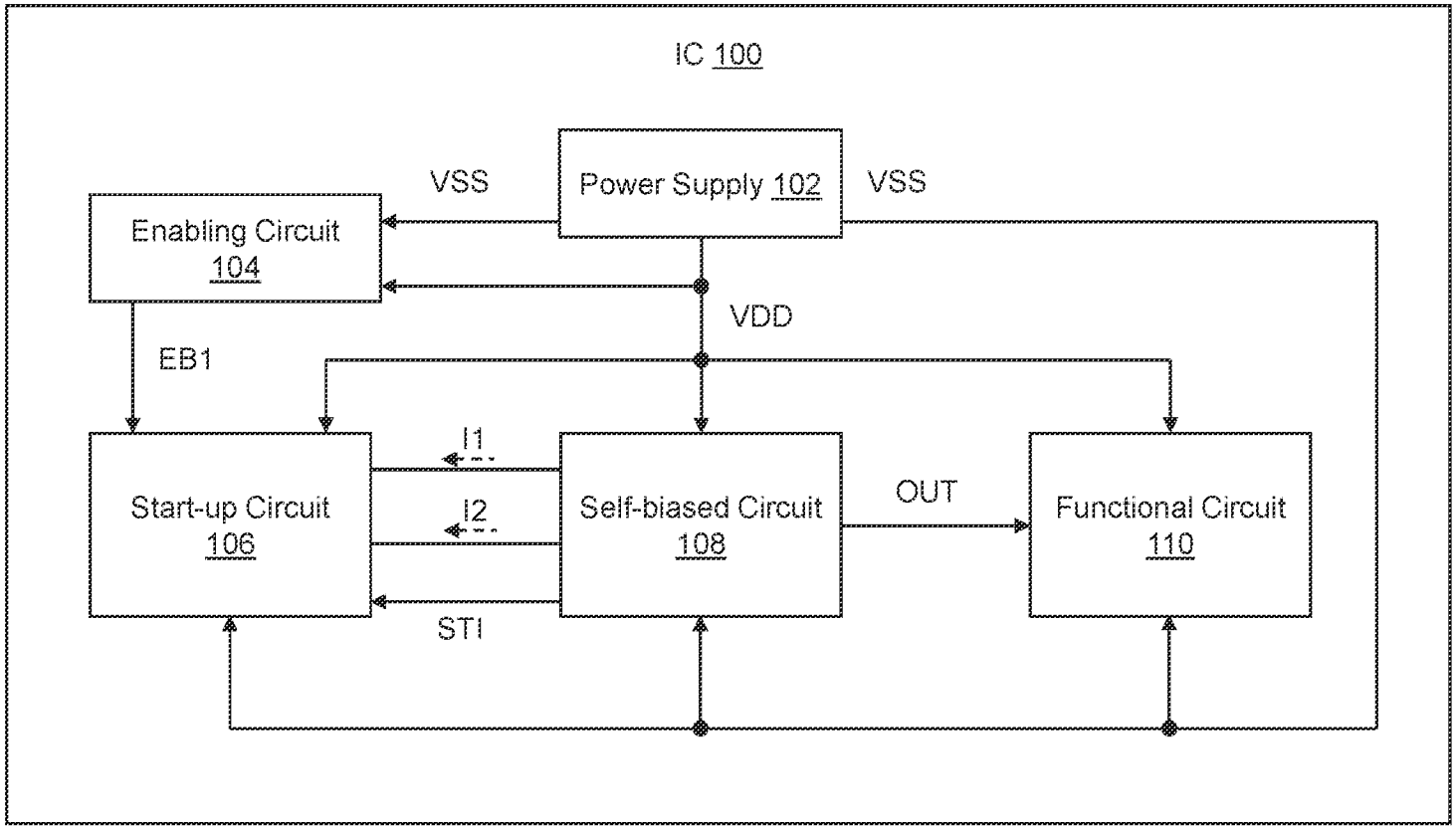
FIG. 1 illustrates a schematic block diagram of an integrated circuit (IC) in accordance with an embodiment of the present disclosure.

The detailed description of the appended drawings is intended as a description of the currently preferred embodiments of the present disclosure, and is not intended to represent the only form in which the present disclosure may be practiced. It is to be understood that the same or equivalent functions may be accomplished by different embodiments that are intended to be encompassed within the spirit and scope of the present disclosure.

In an embodiment of the present disclosure, a circuit is disclosed. The circuit may include a self-biased circuit and a start-up circuit coupled to the self-biased circuit. The self-biased circuit may be configured to generate a start-up indicator signal that indicates whether the self-biased circuit has started up, and an output signal. The start-up circuit may include a comparator that may be configured to compare the start-up indicator signal with a reference signal and generate a comparison signal based on the comparison of the start-up indicator signal with the reference signal. The reference signal may be generated based on a first supply voltage and a second supply voltage of the start-up circuit. The start-up circuit may further include a start-up controller and a peak controller. The start-up controller may be configured to control a start-up of the self-biased circuit when the comparison signal is at a first logic state. The peak controller may be configured to control the output signal to maintain at least one of a group consisting of a voltage level and a current level of the output signal below a peak limit. The peak controller controls the output signal when the comparison signal transitions from the first logic state to a second logic state.

In another embodiment of the present disclosure, a start-up method for a self-biased circuit is disclosed. The start-up method may include comparing, by a comparator of a start-up circuit, a start-up indicator signal with a reference signal. The start-up indicator signal indicates whether the self-biased circuit has started up. The reference signal is generated based on a first supply voltage and a second supply voltage of the start-up circuit. The start-up method may further include generating a comparison signal by the comparator based on the comparison of the start-up indicator signal with the reference signal. Further, the start-up method may include controlling a start-up of the self-biased circuit by a start-up controller of the start-up circuit. The start-up of the self-biased circuit may be controlled when the comparison signal is at a first logic state. The start-up method may further include controlling an output signal of the self-biased circuit by a peak controller of the start-up circuit. The output signal may be controlled when the comparison signal transitions from the first logic state to a second logic state. Further, the output signal may be controlled to maintain at least one of a group consisting of a voltage level and a current level of the output signal below a peak limit.

In some embodiments, the start-up circuit may further include a pulse generator that may be coupled to the comparator and the peak controller. The pulse generator may be configured to receive the comparison signal, generate a pulse signal when the comparison signal transitions from the first logic state to the second logic state, and provide the pulse signal to the peak controller. The peak controller may control the output signal based on the pulse signal.

In some embodiments, the peak controller may include a set of transistors. To control the output signal, the set of transistors may be configured to pull down the output signal to the second supply voltage for a predefined time duration that is equal to a pulse width of the pulse signal. The second supply voltage is less than the first supply voltage.

In some embodiments, the start-up circuit may further include a reference signal generator that may be coupled to the comparator. The reference signal generator may be configured to receive the first and second supply voltages, generate the reference signal that has a voltage level less than a difference between the first and second supply voltages, and provide the reference signal to the comparator for the comparison with the start-up indicator signal.

In some embodiments, the start-up circuit may further include a toggle circuit. The toggle circuit may be configured to output, based on a first enable signal and the comparison signal, a control signal to activate and deactivate the comparator. The comparator may be activated and deactivated based on deactivation and activation of the control signal, respectively.

In some embodiments, the control signal is deactivated based on activation of the first enable signal. Further, the control signal toggles based on deactivation of the first enable signal and the transition of the comparison signal from the first logic state to the second logic state.

In some embodiments, the control signal is deactivated based on activation of the first enable signal. Further, the control signal toggles based on deactivation of the first enable signal and the transition of the comparison signal from the first logic state to the second logic state for a predefined number of times.

In some embodiments, the start-up circuit may further include a counter that may be coupled to the comparator. The counter may be configured to receive the comparison signal and the first enable signal. The counter may be reset based on the activation of the first enable signal. Further, the counter may be configured to generate a count such that the count is incremented at each transition of the comparison signal from the first logic state to the second logic state. The count being equal to a threshold limit indicates that the comparison signal has transitioned from the first logic state to the second logic state for the predefined number of times.

In some embodiments, the control signal is deactivated based on activation of the first enable signal. Further, the control signal toggles based on deactivation of the first enable signal and lapse of a predefined time duration after the transition of the comparison signal from the first logic state to the second logic state.

In some embodiments, the start-up circuit may further include a monitoring circuit. The monitoring circuit may be configured to receive the first and second supply voltages and generate a second enable signal to control the toggle circuit. The toggle circuit is reset based on deactivation of the second enable signal.

In some embodiments, the second enable signal is activated when a difference between the first supply voltage and the second supply voltage is greater than or equal to a threshold limit. Further, the second enable signal is deactivated when the difference between the first supply voltage and the second supply voltage is less than the threshold limit.

In some embodiments, the start-up circuit may further include a logic gate that may be coupled to the monitoring circuit. The logic gate may be configured to receive the second enable signal and a third enable signal and output the first enable signal. An operation of the start-up circuit is controlled based on the third enable signal. The first enable signal is activated based on deactivation of at least one of a group consisting of the second enable signal and the third enable signal. Further, the first enable signal is deactivated based on activation of the second enable signal and the third enable signal.

In some embodiments, the start-up circuit may further include a delay circuit that may be coupled to the toggle circuit and the comparator. The delay circuit may be configured to receive the control signal, output a delayed version of the control signal, and provide the delayed version of the control signal to the comparator to control the comparator.

In some embodiments, to control the start-up of the self-biased circuit, the start-up controller may be further configured to source a current to the self-biased circuit when the comparison signal is at the first logic state.

In some embodiments, to control the start-up of the self-biased circuit, the start-up controller may be further configured to sink a current from the self-biased circuit when the comparison signal is at the first logic state.

In some embodiments, the self-biased circuit may include one of a group consisting of a current reference circuit, a voltage reference circuit, and a self-referenced voltage regulator.

In some embodiments, the start-up indicator signal is same as the output signal.

In some embodiments, the comparison signal at the first logic state indicates that one of a group consisting of a voltage level and a current level of the reference signal is greater than that of the start-up indicator signal. Further, the comparison signal at the second logic state indicates that one of a group consisting of the voltage level and the current level of the reference signal is less than or equal to that of the start-up indicator signal.

In some embodiments, the comparison signal at the first logic state indicates that one of a group consisting of a voltage level and a current level of the reference signal is less than or equal to that of the start-up indicator signal. Further, the comparison signal at the second logic state indicates that one of a group consisting of the voltage level and the current level of the reference signal is greater than that of the start-up indicator signal.

Various embodiments of the present disclosure disclose an integrated circuit (IC) that may include a self-biased circuit and a start-up circuit for the self-biased circuit. The self-biased circuit may generate a start-up indicator signal that indicates whether the self-biased circuit has started up, and an output signal. The start-up circuit may include a comparator, a start-up controller, and a peak controller. The comparator may compare the start-up indicator signal with a reference signal and generate a comparison signal based on the comparison of the start-up indicator signal with the reference signal. The reference signal is a scaled-down version of a range of a power supply of the IC. The start-up controller may control a start-up of the self-biased circuit when the comparison signal is at a first logic state. To control the start-up of the self-biased circuit, the start-up controller may source a current to the self-biased circuit or sink the current from the self-biased circuit. When the comparison signal transitions from the first logic state to a second logic state, the peak controller may control the output signal to maintain a voltage level or a current level of the output signal below a peak limit. The start-up circuit of the present disclosure includes various components and signals that are digital. The start-up circuit of the present disclosure thus corresponds to a digitally-assisted start-up circuit.

Thus, the start-up circuit of the present disclosure facilitates the start-up of the self-biased circuit, thereby preventing an operational failure of the IC. Some conventional start-up circuits include exclusively analog components that render the conventional start-up circuits sensitive to supply and temperature variations in an IC. As a result, some conventional start-up circuits may need to be modified if there is a change in any of these parameters. The analog nature of some conventional start-up circuits further renders exhaustive verification of such start-up circuits difficult. As a result, the reliability of some conventional start-up circuits degrades. Further, some conventional start-up circuits have issues due to overshooting of output signals on completion of the start-up.

In some embodiments of the present disclosure, the start-up circuit controls the start-up of the self-biased circuit and further controls the output signal on completion of the start-up. As a result, a voltage level or the current level of the output signal is less than the peak limit on completion of the start-up. Thus, overshooting of the output signal on completion of the start-up is prevented. The digitally-assisted start-up circuit of some embodiments of the present disclosure is significantly less sensitive to the supply and temperature variations in the IC as compared to some conventional start-up circuits. Thus, the supply and temperature variations in the IC do not result in significant modifications in the start-up circuit, thereby eliminating a need for verifying the start-up circuit for the supply and temperature variations in the IC. As a result, the reliability of the start-up circuit of such embodiments of the present disclosure is significantly higher than that of some conventional start-up circuits.

FIG. 1 illustrates a schematic block diagram of an integrated circuit (IC) 100 in accordance with an embodiment of the present disclosure. The IC 100 may include a power supply 102, an enabling circuit 104, a start-up circuit 106, a self-biased circuit 108, and a functional circuit 110.

The power supply 102 may be configured to generate a first supply voltage VDD and a second supply voltage VSS. The second supply voltage VSS is less than the first supply voltage VDD. Further, the second supply voltage VSS may be equal to a ground voltage (e.g., 0 volts). However, in other embodiments, the second supply voltage VSS may be at other values, such as at less than the ground voltage (e.g., −1 volt) or greater than the ground voltage (e.g., 1 volt).

Although FIG. 1 illustrates that all of the circuits are implemented on IC 100, in other embodiments, some of the circuitry may be located external to the IC 100. For example, in some embodiments, the power supply 102 may be external to the IC 100.

The enabling circuit 104 may be coupled to the power supply 102 and the start-up circuit 106. The enabling circuit 104 may include suitable circuitry that may be configured to perform one or more operations. For example, the enabling circuit 104 may be configured to receive the first and second supply voltages VDD and VSS from the power supply 102. Based on the first and second supply voltages VDD and VSS, the enabling circuit 104 may be further configured to generate a first enable signal EB1. When a difference between the first and second supply voltages VDD and VSS is less than a first threshold limit (not shown), the first enable signal EB1 is in an undefined state. In an example, when the difference between the first and second supply voltages VDD and VSS is less than the first threshold limit, the first enable signal EB1 is deactivated (e.g., is at a logic low state). The first threshold limit may be indicative of a voltage level that is required for an accurate operation of the IC 100. Further, when the difference between the first and second supply voltages VDD and VSS is greater than or equal to the first threshold limit, the first enable signal EB1 may be activated or deactivated to control the operation of the start-up circuit 106. In an embodiment, the enabling circuit 104 deactivates the first enable signal EB (e.g., generates the first enable signal EB1 at a logic low state) to deactivate the start-up circuit 106. Further, the enabling circuit 104 activates the first enable signal EB1 (e.g., generates the first enable signal EB1 at a logic high state) to activate the start-up circuit 106. The enabling circuit 104 may be further configured to provide the first enable signal EB1 to the start-up circuit 106.

The start-up circuit 106 may be coupled to the power supply 102, the enabling circuit 104, and the self-biased circuit 108. The start-up circuit 106 may be configured to receive the first and second supply voltages VDD and VSS from the power supply 102. Further, the start-up circuit 106 may be configured to receive a start-up indicator signal STI that is generated by the self-biased circuit 108. The start-up indicator signal STI indicates whether the self-biased circuit 108 has started up. The start-up indicator signal STI is a voltage signal. However, the scope of the present disclosure is not limited to it. In an alternate embodiment, the start-up indicator signal STI may be a current signal, without deviating from the scope of the present disclosure.

The start-up circuit 106 may be further configured to receive the first enable signal EB1 from the enabling circuit 104. The operation of the start-up circuit 106 is controlled based on the first enable signal EB1 and the first and second supply voltages VDD and VSS. The start-up circuit 106 is non-operational when the first enable signal EB1 is deactivated (e.g., is at a logic low state) and/or when the difference between the first and second supply voltages VDD and VSS is less than the first threshold limit. Further, the start-up circuit 106 is operational when the first enable signal EB1 is activated (e.g., is at a logic high state) and the difference between the first and second supply voltages VDD and VSS is greater than or equal to the first threshold limit. When the start-up circuit 106 is operational, the start-up circuit 106 may be configured to control the self-biased circuit 108 based on the first and second supply voltages VDD and VSS and the start-up indicator signal STI. The start-up circuit 106 controls the self-biased circuit 108 during a start-up of the self-biased circuit 108 and on completion of the start-up.

The control of the self-biased circuit 108 includes starting up the self-biased circuit 108 and maintaining a voltage level or a current level of an output signal OUT of the self-biased circuit 108 below a peak limit on completion of the start-up. In other words, the control of the self-biased circuit 108 includes controlling a start-up of the self-biased circuit 108 and controlling the output signal OUT when the self-biased circuit 108 has started up. The peak limit may correspond to a maximum tolerable voltage or current associated with the functional circuit 110. Further, the start-up circuit 106 is deactivated after the self-biased circuit 108 has started up successfully.

To control the start-up of the self-biased circuit 108, the start-up circuit 106 may be configured to source a first current I1 to the self-biased circuit 108 or sink the first current I1 from the self-biased circuit 108. The first current I1 may be sourced to or sunk from the self-biased circuit 108 for a first predefined time duration to start up the self-biased circuit 108. In an example, the first predefined time duration is equal to 14 microseconds. However, the first predefined time duration may have other values in other embodiments. Thus, on the lapse of the first predefined time duration, the self-biased circuit 108 is has started up. The successful start-up of the self-biased circuit 108 is determined based on the start-up indicator signal STI.

To control the output signal OUT, the start-up circuit 106 may be configured to sink a second current I2 from the self-biased circuit 108. In other words, the start-up circuit 106 may be configured to pull down the output signal OUT to maintain at least one of the voltage level and the current level of the output signal OUT below the peak limit. The output signal OUT is pulled down for a second predefined time duration after the self-biased circuit 108 has started up. The output signal OUT is a voltage signal. Thus, the start-up circuit 106 may pull down the output signal OUT to the second supply voltage VSS. However, the scope of the present disclosure is not limited to the output signal OUT being a voltage signal. In an alternate embodiment, the output signal OUT may be a current signal, without deviating from the scope of the present disclosure. The start-up circuit 106 operates at a wide range of the power supply 102 (e.g., 0-2.5 volts). The start-up circuit 106 is explained in detail in conjunction with FIGS. 3-7.

The scope of the present disclosure is not limited to the start-up circuit 106 controlling the self-biased circuit 108 based on the start-up indicator signal STI. In an alternate embodiment, the start-up circuit 106 may be configured to control the self-biased circuit 108 based on the output signal OUT instead of the start-up indicator signal STI, without deviating from the scope of the present disclosure.

The self-biased circuit 108 may be coupled to the start-up circuit 106, the functional circuit 110, and the power supply 102. The self-biased circuit 108 may include suitable circuitry that may be configured to perform one or more operations. For example, the self-biased circuit 108 may be configured to receive the first and second supply voltages VDD and VSS from the power supply 102. Further, the first current I1 may be sourced to or sunk from the self-biased circuit 108 during the start-up. For the sake of ongoing discussion, it is assumed that the first current I1 is sunk from the self-biased circuit 108 during the start-up.

The self-biased circuit 108 may be further configured to generate the start-up indicator signal STI and the output signal OUT. The voltage level of the start-up indicator signal STI may be equal to one of the first and second supply voltages VDD and VSS before the start-up is controlled by the start-up circuit 106 (e.g., when the self-biased circuit 108 is not started up). When the first current I1 is sunk from the self-biased circuit 108, the voltage level of the start-up indicator signal STI changes (e.g., decreases if equal to the first supply voltage VDD and increases if equal to the second supply voltage VSS). In such a scenario, the first predefined time duration corresponds to the time required for the voltage level of the start-up indicator signal STI to reach the desired value. The start-up indicator signal STI may be an intermediate signal generated by the self-biased circuit 108. However, the scope of the present disclosure is not limited to it. In various other embodiments, the start-up indicator signal STI may be same as the output signal OUT, without deviating from the scope of the present disclosure.

The self-biased circuit 108 may generate the output signal OUT at an output terminal thereof. In an embodiment, the second current I2 is sunk from the output terminal of the self-biased circuit 108 on completion of the start-up. In other words, the output terminal of the self-biased circuit 108 is pulled down to the second supply voltage VSS. However, the scope of the present disclosure is not limited to it. In various other embodiments, an intermediate node (e.g., a node before the output terminal) of the self-biased circuit 108 may be controlled to maintain the voltage level of the output signal OUT below the peak limit, without deviating from the scope of the present disclosure. In such a scenario, the second current I2 may be sourced to or sunk from the intermediate node to pull down the output signal OUT to the second supply voltage VSS. In other words, the intermediate node may be pulled up to the first supply voltage VDD or pulled down to the second supply voltage VSS to pull down the output signal OUT to the second supply voltage VSS. The self-biased circuit 108 may be further configured to provide the start-up indicator signal STI to the start-up circuit 106 and the output signal OUT to the functional circuit 110. The self-biased circuit 108 may include a current reference circuit, a voltage reference circuit, a self-referenced voltage regulator, or the like.

When the first supply voltage VDD is ramping up and/or when the first enable signal EB1 is deactivated (e.g., is at a logic low state), the start-up circuit 106 is non-operational. When the difference between the first and second supply voltages VDD and VSS is greater than or equal to the first threshold limit and when the first enable signal EB1 is activated (e.g., is at a logic high state), the start-up circuit 106 is operational. In such a scenario, the voltage level of the start-up indicator signal STI may be equal to one of the first and second supply voltages VDD and VSS. The start-up circuit 106 thus sinks the first current I1 for the first predefined time duration from the self-biased circuit 108. Based on the first current I1, the voltage level of the start-up indicator signal STI changes (e.g., decreases if equal to the first supply voltage VDD and increases if equal to the second supply voltage VSS) until the voltage level of the start-up indicator signal STI reaches the desired value. The voltage level of the start-up indicator signal STI being equal to the desired value indicates that the self-biased circuit 108 has started up successfully. When the self-biased circuit 108 has started up successfully, the output signal OUT may be pulled down to the second supply voltage VSS for the second predefined time duration to prevent overshooting of the output signal OUT. Further, the start-up circuit 106 is deactivated after the self-biased circuit 108 has started up successfully. The self-biased circuit 108 is thus controlled by the start-up circuit 106 during and on completion of the start-up of the self-biased circuit 108. The self-biased circuit 108 is explained in conjunction with FIG. 2.

The functional circuit 110 may be coupled to the self-biased circuit 108 and the power supply 102. The functional circuit 110 may include suitable circuitry that may be configured to perform one or more operations. For example, the functional circuit 110 may be configured to receive the first and second supply voltages VDD and VSS from the power supply 102 and the output signal OUT from the self-biased circuit 108. Further, the functional circuit 110 may be configured to perform one or more functional operations associated therewith based on the output signal OUT and the first and second supply voltages VDD and VSS. Examples of the functional circuit 110 may include analog-to-digital converters, power management units, amplifiers, filters, sensors, or the like.

It will be apparent to a person skilled in the art that the IC 100 is shown to include one start-up circuit, one self-biased circuit, and one functional circuit to make the illustrations concise and clear and should not be considered as a limitation of the present disclosure. In various other embodiments, the IC 100 may include more than one start-up circuit, more than one self-biased circuit, and more than one functional circuit operating in a similar manner as described above, without deviating from the scope of the present disclosure.

Figure 2:
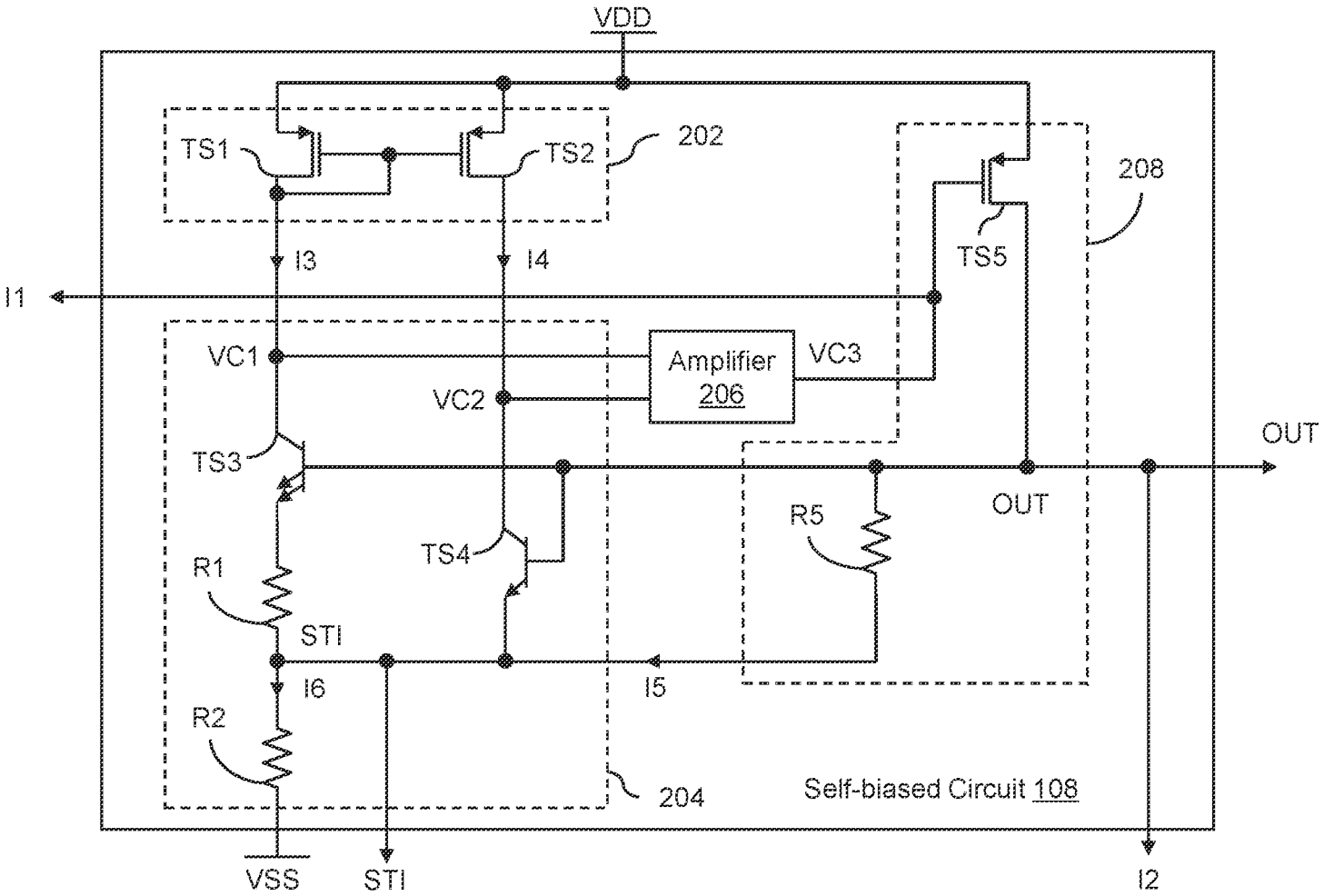
FIG. 2 illustrates a schematic circuit diagram of a self-biased circuit of the IC of FIG. 1 in accordance with an embodiment of the present disclosure.

FIG. 2 illustrates a schematic circuit diagram of the self-biased circuit 108 in accordance with an embodiment of the present disclosure. The self-biased circuit 108 may include a current mirror 202, a bandgap core circuit 204, an amplifier 206, and a feedback circuit 208. The self-biased circuit 108 illustrated in FIG. 2 corresponds to one exemplary implementation of the self-biased circuit 108 and should not be considered as a limitation of the present disclosure. In other embodiments, the self-biased circuit 108 may be implemented in a different manner, without deviating from the scope of the present disclosure.

The current mirror 202 may be coupled to the power supply 102, and configured to receive the first supply voltage VDD. The current mirror 202 may include first and second transistors TS1 and TS2, each having first through third terminals. The first terminals of the first and second transistors TS1 and TS2 may be coupled to the power supply 102, and configured to receive the first supply voltage VDD, and the second terminals of the first and second transistors TS1 and TS2 may be coupled to each other. The third terminal of the first transistor TS1 may be coupled to the second terminals of the first and second transistors TS1 and TS2. In an embodiment, the first and second transistors TS1 and TS2 are p-channel metal-oxide-semiconductor (PMOS)

transistors, and the first through third terminals of the first and second transistors TS1 and TS2 correspond to source, gate, and drain terminals, respectively.

The bandgap core circuit 204 may be coupled to the current mirror 202. The bandgap core circuit 204 may include third and fourth transistors TS3 and TS4 and first and second resistors R1 and R2. Each of the third and fourth transistors TS3 and TS4 has first through third terminals and each of the first and second resistors R1 and R2 has first and second terminals. The size of the third transistor TS3 is greater than the size of the fourth transistor TS4. The first terminals of the third and fourth transistors TS3 and TS4 may be coupled to the third terminals of the first and second transistors TS1 and TS2, respectively. The second terminals of the third and fourth transistors TS3 and TS4 may be configured to receive the output signal OUT. In an embodiment, the third and fourth transistors TS3 and TS4 are NPN transistors, and the first through third terminals of the third and fourth transistors TS3 and TS4 correspond to collector, base, and emitter terminals, respectively. The first and second terminals of the first resistor R1 may be coupled to the third terminals of the third and fourth transistors TS3 and TS4, respectively. The first terminal of the second resistor R2 may be coupled to the second terminal of the first resistor R1. Further, the second terminal of the second resistor R2 may be coupled to the power supply 102, and configured to receive the second supply voltage VSS.

A third current I3 propagates in a first branch of the bandgap core circuit 204 (e.g., the third transistor TS3 and the first and second resistors R1 and R2). The third current I3 may be generated by the bandgap core circuit 204 and sunk from the current mirror 202. The current mirror 202 mirrors the third current I3 to output a fourth current I4 that propagates in a second branch of the bandgap core circuit 204 (e.g., the fourth transistor TS4 and the second resistor R2). The second terminal of the first resistor R1 may be further configured to receive a fifth current I5. The first terminal of the second resistor R2 thus receives a sixth current I6 that is equal to a sum of the third, fourth, and fifth currents I3, I4, and I5.

The bandgap core circuit 204 may be further configured to generate first and second control voltages VC1 and VC2 at the first terminals of the third and fourth transistors TC3 and TC4, respectively. The first control voltage VC1 may be generated based on the third and fifth currents I3 and I5 and the output signal OUT. Similarly, the second control voltage VC2 may be generated based on the fourth and fifth currents I4 and I5 and the output signal OUT. The first and second control voltages VC1 and VC2 may correspond to collector-emitter voltages of the third and fourth transistors TS3 and TS4, respectively. Further, based on the sixth current I6 passing through the second resistor R2 (e.g., a voltage drop across the second resistor R2), the start-up indicator signal STI may be generated at the first terminal of the second resistor R2. The start-up indicator signal STI may be provided to the start-up circuit 106.

The amplifier 206 may be coupled to the first terminals of the third and fourth transistors TS3 and TS4. The amplifier 206 may be configured to receive the first and second control voltages VC1 and VC2 from the first terminals of the third and fourth transistors TS3 and TS4, respectively. The amplifier 206 may be further configured to generate a third control voltage VC3 such that the third control voltage VC3 may be an amplified version of a difference between the first and second control voltages VC1 and VC2.

The feedback circuit 208 may be coupled to the power supply 102, and configured to receive the first supply voltage VDD. The feedback circuit 208 may be further coupled to the amplifier 206, and configured to receive the third control voltage VC3. Based on the first supply voltage VDD and the third control voltage VC3, the feedback circuit 208 may be further configured to generate the output signal OUT and the fifth current I5. Further, the feedback circuit 208 may be coupled to the bandgap core circuit 204, and configured to provide the output signal OUT and the fifth current I5 to the bandgap core circuit 204. The feedback circuit 208 may be further coupled to the functional circuit 110, and configured to provide the output signal OUT to the functional circuit 110. The feedback circuit 208 may include a fifth transistor TS5 and a fifth resistor R5.

The fifth transistor TS5 has a first terminal that may be configured to receive the first supply voltage VDD from the power supply 102, and a second terminal that may be configured to receive the third control voltage VC3 from the amplifier 206. The fifth transistor TS5 further has a third terminal that may be coupled to the second terminals of the third and fourth transistors TS3 and TS4. The second and third terminals of the fifth transistor TS5 may be further coupled to the start-up circuit 106. In an embodiment, the fifth transistor TS5 is a PMOS transistor, and the first through third terminals of the fifth transistor TS5 correspond to source, gate, and drain terminals, respectively. The fifth resistor R5 has a first terminal that may be coupled to the third terminal of the fifth transistor TS5 and the second terminals of the third and fourth transistors TS3 and TS4. The fifth resistor R5 further has a second terminal that may be coupled to the bandgap core circuit 204 (e.g., the second terminal of the first resistor R1).

Based on the first supply voltage VDD and the third control voltage VC3, the output signal OUT may be generated at the third terminal of the fifth transistor TS5. Similarly, the fifth current I5 may be generated that is provided to the second terminal of the first resistor R1. In other words, the third control voltage VC3 controls the drive strength of the fifth transistor TS5, and in turn, the output signal OUT and the fifth current I5. Further, the third terminal of the fifth transistor TS5 corresponds to the output terminal of the self-biased circuit 108. As illustrated in FIG. 2, the output signal OUT may be equal to a sum of a base-emitter voltage of the fourth transistor TS4 and the voltage level of the start-up indicator signal STI. The self-biased circuit 108 thus corresponds to a voltage reference circuit that generates a bandgap reference voltage (e.g., the output signal OUT).

The self-biased circuit 108 is required to be started up to prevent the operational failure of the self-biased circuit 108, and in turn, the IC 100. When the self-biased circuit 108 is turned off, the self-biased circuit 108 is devoid of current flow (e.g., no current propagates through the self-biased circuit 108). In other words, the first and second terminals of the fifth transistor TS5 are at the same voltage level (e.g., the fifth transistor TS5 is non-operational) and the voltage levels of the start-up indicator signal STI and the output signal OUT are equal to the second supply voltage VSS. Based on such a start-up indicator signal STI, the start-up circuit 106 controls the start-up of the self-biased circuit 108 such that the first current I1 is sunk from the second terminal of the fifth transistor TS5. As a result, the voltage level of the second terminal of the fifth transistor TS5 decreases until the fifth transistor TS5 is operational.

When the fifth transistor TS5 is operational, the voltage level of the output signal OUT increases such that the third and fourth transistors TS3 and TS4 are operational. Further, the sixth current I6 passes through the second resistor R2, thereby increasing the voltage level of the start-up indicator signal STI. The bandgap core circuit 204 is thus operational, and the output signal OUT is generated as the sum of the base-emitter voltage of the fourth transistor TS4 and the voltage level of the start-up indicator signal STI. The start-up of the self-biased circuit 108 is thus controlled by the start-up circuit 106. The sinking of the first current I1 from the second terminal of the fifth transistor TS5 stops when the voltage level of the start-up indicator signal STI reaches the desired value. This is indicative of the successful start-up of the self-biased circuit 108. On completion of the start-up of the self-biased circuit 108, the second current I2 is sunk from the third terminal of the fifth transistor TS5. As a result, the output signal OUT is pulled down to the second supply voltage VSS. In other words, the voltage level of the output signal OUT decreases. The start-up circuit 106 thus controls the output signal OUT to maintain the voltage level of the output signal OUT below the peak limit on completion of the start-up.

Figure 3:
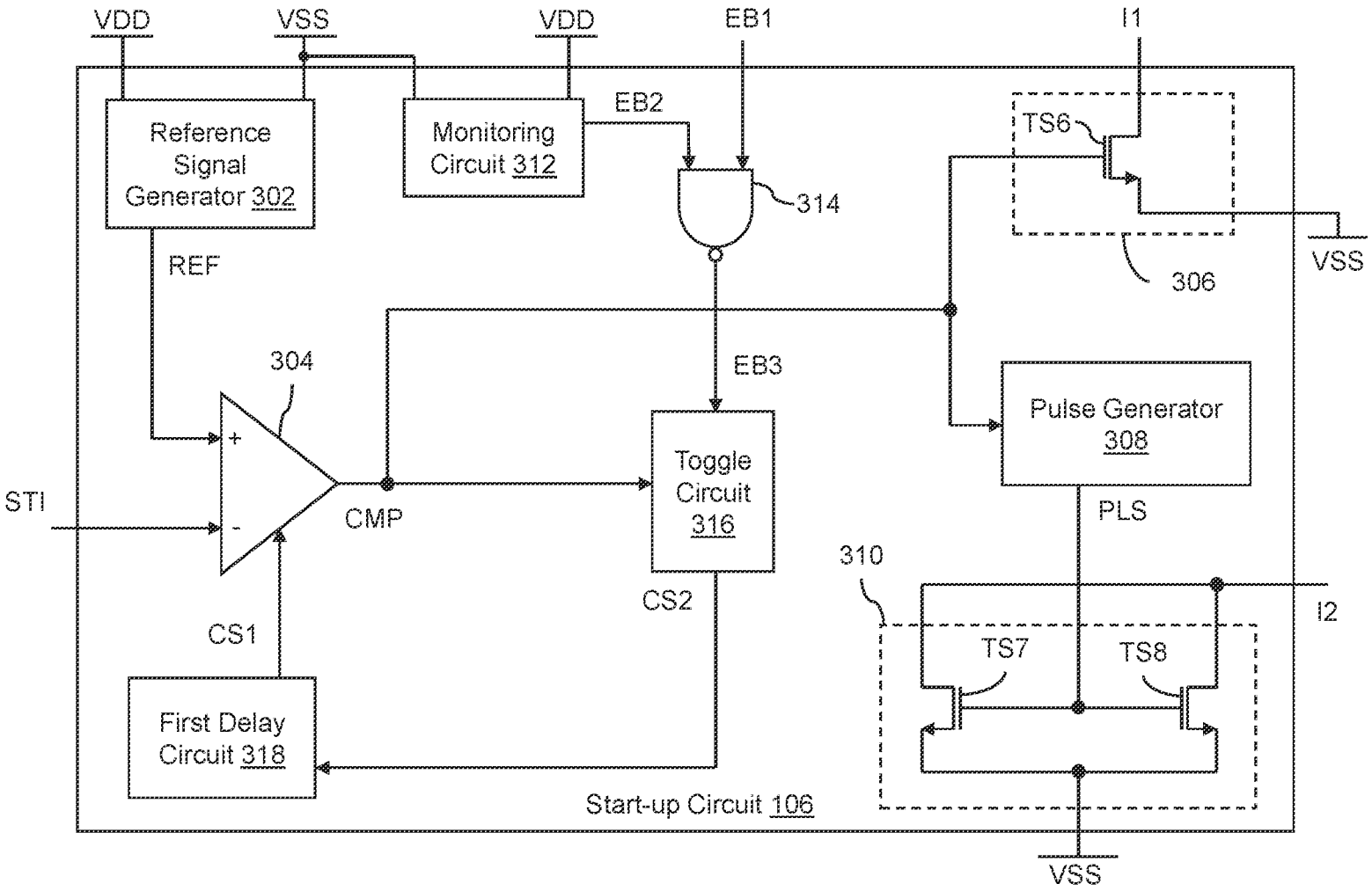
FIG. 3 illustrates a schematic circuit diagram of a start-up circuit of the IC of FIG. 1 in accordance with an embodiment of the present disclosure.

FIG. 3 illustrates a schematic circuit diagram of the start-up circuit 106 in accordance with an embodiment of the present disclosure. The start-up circuit 106 may include a reference signal generator 302, a comparator 304, a start-up controller 306, a pulse generator 308, and a peak controller 310. The start-up circuit 106 may further include a monitoring circuit 312, a first logic gate 314, a toggle circuit 316, and a first delay circuit 318.

The reference signal generator 302 may be coupled to the power supply 102 and the comparator 304. The reference signal generator 302 may include suitable circuitry that may be configured to perform one or more operations. For example, the reference signal generator 302 may be configured to receive the first and second supply voltages VDD and VSS from the power supply 102. Further, the reference signal generator 302 may be configured to generate a reference signal REF based on the first and second supply voltages VDD and VSS and provide the reference signal REF to the comparator 304. The reference signal REF is a voltage signal. In such a scenario, a voltage level of the reference signal REF is less than a range of the power supply 102 (e.g., a difference between the first and second supply voltages VDD and VSS). In other words, the voltage level of the reference signal REF is greater than the second supply voltage VSS and less than the first supply voltage VDD. However, the scope of the present disclosure is not limited to the reference signal REF being a voltage signal. In an alternate embodiment, the reference signal REF may be a current signal, without deviating from the scope of the present disclosure.

Although FIG. 3 illustrates that the start-up circuit 106 may include the reference signal generator 302, the scope of the present disclosure is not limited to it. In an alternate embodiment, the reference signal generator 302 may be external to the start-up circuit 106, without deviating from the scope of the present disclosure.

The comparator 304 may be coupled to the first delay circuit 318, the self-biased circuit 108, the reference signal generator 302, the start-up controller 306, and the pulse generator 308. The comparator 304 may include suitable circuitry to perform one or more operations. For example, the comparator 304 may be configured to receive a first control signal CS1 from the first delay circuit 318. Further, the comparator 304 may be configured to receive the start-up indicator signal STI and the reference signal REF from the self-biased circuit 108 and the reference signal generator 302, respectively. Although not illustrated, the comparator 304 may be further configured to receive the first and second supply voltages VDD and VSS at supply terminals thereof.

The first control signal CS1 and the first and second supply voltages VDD and VSS control an operation of the comparator 304. When the first control signal CS1 is activated (e.g., is at a logic high state) and/or when the difference between the first and second supply voltages VDD and VSS is less than the first threshold limit, the comparator 304 is non-operational. Further, when the first control signal CS1 is de-asserted (e.g., is at a logic low state) and when the difference between the first and second supply voltages VDD and VSS is greater than or equal to the first threshold limit, the comparator 304 is operational.

When the comparator 304 is operational, the comparator 304 may be further configured to compare the start-up indicator signal STI with the reference signal REF. Based on the comparison of the start-up indicator signal STI with the reference signal REF, the comparator 304 may be further configured to generate a comparison signal CMP. In an embodiment, the comparator 304 may generate the comparison signal CMP at a first logic state when the voltage level of the reference signal REF is greater than the voltage level of the start-up indicator signal STI. Further, the comparator 304 may generate the comparison signal CMP at a second logic state when the voltage level of the reference signal REF is less than or equal to the voltage level of the start-up indicator signal STI. In a presently preferred embodiment, the first logic state and the second logic state correspond to a logic high state and a logic low state, respectively. The comparator 304 may be further configured to provide the comparison signal CMP to the start-up controller 306 and the pulse generator 308.

When the first supply voltage VDD is ramping up, the first control signal CS1 is deactivated (e.g., is at a logic low state). However, as the difference between the first and second supply voltages VDD and VSS is less than the first threshold limit, the comparator 304 is non-operational. Further, when the difference between the first and second supply voltages VDD and VSS is equal to the first threshold limit, the comparator 304 is operational. At such a time instance, it is assumed that the voltage level of the start-up indicator signal STI is equal to the second supply voltage VSS. Further, the voltage level of the reference signal REF is greater than the second supply voltage VSS. Thus, the comparison signal CMP is at the first logic state (e.g., is at a logic high state). Further, as the start-up of the self-biased circuit 108 is controlled by the start-up circuit 106, the voltage level of the start-up indicator signal STI increases. When the voltage level of the start-up indicator signal STI is equal to the voltage level of the reference signal REF, the comparison signal CMP transitions from the first logic state to the second logic state (e.g., from a logic high state to a logic low state).

The scope of the present disclosure is not limited to the comparator 304 operating in an afore-mentioned manner. In an alternate embodiment, the comparator 304 may generate the comparison signal CMP at the first logic state when the voltage level of the reference signal REF is less than or equal to the voltage level of the start-up indicator signal STI. Further, the comparator 304 may generate the comparison signal CMP at the second logic state when the voltage level of the reference signal REF is greater than the voltage level of the start-up indicator signal STI. In such a scenario, the initial voltage level of the start-up indicator signal STI is equal to the first supply voltage VDD, and decreases when the start-up of the self-biased circuit 108 is controlled by the start-up circuit 106. Further, the comparison signal CMP transitions from the first logic state to the second logic state when the voltage level of the start-up indicator signal STI is equal to the voltage level of the reference signal REF.

Although it is described that the comparator 304 compares the start-up indicator signal STI with the reference signal REF, the scope of the present disclosure is not limited to it. In various other embodiments, the comparator 304 may receive the output signal OUT instead of the start-up indicator signal STI. In such a scenario, the comparison signal CMP may be generated based on the comparison of the output signal OUT with the reference signal REF.

The start-up controller 306 may be coupled to the comparator 304, the self-biased circuit 108 (e.g., the second terminal of the fifth transistor TS5), and the power supply 102. The start-up controller 306 may include suitable circuitry configured to perform one or more operations. For example, the start-up controller 306 may be configured to receive the comparison signal CMP from the comparator 304 and the second supply voltage VSS from the power supply 102. The comparison signal CMP controls an operation of the start-up controller 306. In an embodiment, the start-up controller 306 is operational when the comparison signal CMP is at the first logic state (e.g., is at a logic high state). Conversely, the start-up controller 306 is non-operational when the comparison signal CMP is at the second logic state (e.g., is at a logic low state). When the start-up controller 306 is operational, the start-up controller 306 may be further configured to control the start-up of the self-biased circuit 108 based on the second supply voltage VSS. Thus, the start-up controller 306 may control the start-up of the self-biased circuit 108 when the comparison signal CMP is at the first logic state (e.g., is at a logic high state).

To control the start-up of the self-biased circuit 108, the start-up controller 306 may be further configured to sink, based on the comparison signal CMP and the second supply voltage VSS, the first current I1 from the self-biased circuit 108. In other words, the start-up controller 306 pulls the second terminal of the fifth transistor TS5 down to the second supply voltage VSS. The first current I1 is sunk from the self-biased circuit 108 while the comparison signal CMP is at the first logic state (e.g., is at a logic high state). In a presently preferred embodiment, the start-up controller 306 includes a first set of transistors of which a sixth transistor TS6 is shown. The first set of transistors may be parallelly coupled between the power supply 102 and the self-biased circuit 108 (e.g., the second terminal of the fifth transistor TS5). As shown in FIG. 3, a first terminal of the sixth transistor TS6 may be coupled to the power supply 102, a second terminal of the sixth transistor TS6 may be coupled to the comparator 304, and a third terminal of the sixth transistor TS6 may be coupled to the self-biased circuit 108 (e.g., the second terminal of the fifth transistor TS5). As the start-up controller 306 is operational when the comparison signal CMP is at a logic high state, each transistor of the first set of transistors corresponds to an n-channel metal-oxide-semiconductor (NMOS) transistor. In such a scenario, the first, second, and third terminals of the sixth transistor TS6 correspond to source, gate, and drain terminals, respectively.

The scope of the present disclosure is not limited to the start-up controller 306 pulling the self-biased circuit 108 (e.g., the second terminal of the fifth transistor TS5) down to the second supply voltage VSS to control the start-up of the self-biased circuit 108. In an alternate embodiment, the start-up controller 306 may source the first current I1 to the self-biased circuit 108 (e.g., to the second terminal of the fifth transistor TS5), without deviating from the scope of the present disclosure. In such a scenario, the start-up controller 306 may receive the first supply voltage VDD instead of the second supply voltage VSS, may include p-channel metal-oxide-semiconductor (PMOS) transistors instead of NMOS transistors, and may be operational when the comparison signal CMP is at a logic low state instead of a logic high state. Thus, the start-up controller 306 may pull the self-biased circuit 108 up to the first supply voltage VDD to control the start-up of the self-biased circuit 108.

The pulse generator 308 may be coupled to the comparator 304 and the peak controller 310. The pulse generator 308 may include suitable circuitry to perform one or more operations. For example, the pulse generator 308 may be configured to receive the comparison signal CMP from the comparator 304. Further, the pulse generator 308 may be configured to generate a pulse signal PLS when the comparison signal CMP transitions from the first logic state to the second logic state (e.g., during a falling edge of the comparison signal CMP). The pulse signal PLS has a predefined pulse width. In an embodiment, the predefined pulse width of the pulse signal PLS is determined based on a type of the self-biased circuit 108. Further, the pulse generator 308 may be configured to provide the pulse signal PLS to the peak controller 310.

The peak controller 310 may be coupled to the power supply 102 and the pulse generator 308. Further, the peak controller 310 may be coupled to the self-biased circuit 108 (e.g., the third terminal of the fifth transistor TS5) The peak controller 310 may include suitable circuitry to perform one or more operations. For example, the peak controller 310 may be configured to receive the pulse signal PLS from the pulse generator 308 and the second supply voltage VSS from the power supply 102. The pulse signal PLS controls an operation of the peak controller 310. In an embodiment, the peak controller 310 is operational when the pulse signal PLS is activated (e.g., is at a logic high state). Conversely, the peak controller 310 is non-operational when the pulse signal PLS is deactivated (e.g., is at a logic low state).

When the peak controller 310 is operational, the peak controller 310 may be configured to control the output signal OUT to maintain the voltage level of the output signal OUT below the peak limit on completion of the start-up of the self-biased circuit 108. The peak controller 310 thus controls the output signal OUT when the pulse signal PLS is activated (e.g., is at a logic high state). In other words, the peak controller 310 controls the output signal OUT when the comparison signal CMP transitions from the first logic state to the second logic state (e.g., from a logic high state to a logic low state).

To control the output signal OUT, the peak controller 310 is further configured to sink, based on the second supply voltage VSS, the second current I2 from the self-biased circuit 108 (e.g., the third terminal of the fifth transistor TS5). In other words, the peak controller 310 may pull down the output signal OUT (e.g., the third terminal of the fifth transistor TS5) to the second supply voltage VSS. The output signal OUT may be pulled down to the second supply voltage VSS for the second predefined time duration to control the output signal OUT. The second predefined time duration for which the output signal OUT may be pulled down to the second supply voltage VSS may be equal to the pulse width of the pulse signal PLS. In a presently preferred embodiment, the peak controller 310 includes a second set of transistors of which a seventh transistor TS7 and an eighth transistor TS8 are shown.

The second set of transistors may be parallelly coupled between the power supply 102 and the self-biased circuit 108 (e.g., the third terminal of the fifth transistor TS5). As shown in FIG. 3, a first terminal of the seventh transistor TS7 may be coupled to the power supply 102, a second terminal of the seventh transistor TS7 may be coupled to the pulse generator 308, and a third terminal of the seventh transistor TS7 may be coupled to the self-biased circuit 108 (e.g., the third terminal of the fifth transistor TS5). Similarly, a first terminal of the eighth transistor TS8 may be coupled to the power supply 102, a second terminal of the eighth transistor TS8 may be coupled to the pulse generator 308, and a third terminal of the eighth transistor TS8 may be coupled to the self-biased circuit 108 (e.g., the third terminal of the fifth transistor TS5). As the peak controller 310 is operational when the pulse signal PLS is at a logic high state, each transistor of the second set of transistors corresponds to an NMOS transistor. In such a scenario, the first, second, and third terminals of the seventh and eighth transistors TS7 and TS8 correspond to source, gate, and drain terminals, respectively. Further, the second set of transistors is configured to pull down the output signal OUT to the second supply voltage VSS for the second predefined time duration that is equal to the pulse width of the pulse signal PLS.

The scope of the present disclosure is not limited to the peak controller 310 pulling the output terminal of the self-biased circuit 108 down to the second supply voltage VSS to control the output signal OUT. In an alternate embodiment, the second current I2 may be sourced to or sunk from the intermediate node of the self-biased circuit 108, without deviating from the scope of the present disclosure. In the other words, the intermediate node of the self-biased circuit 108 is pulled down to the second supply voltage VSS or pulled up to the first supply voltage VDD to control the output signal OUT. When the second current I2 is sunk from the intermediate node of the self-biased circuit 108, the operation of the peak controller 310 remains same as described above. When the second current I2 is sourced to the intermediate node of the self-biased circuit 108, the peak controller 310 may receive the first supply voltage VDD instead of the second supply voltage VSS, may include PMOS transistors instead of NMOS transistors, and may be operational when the pulse signal PLS is at a logic low state instead of a logic high state.

The self-biased circuit 108 is thus started up by the start-up controller 306. Further, when the self-biased circuit 108 has started up successfully, the peak controller 310 pulls down the output signal OUT to the second supply voltage VSS for the second predefined time duration to prevent overshooting (i.e., peaking) of the output signal OUT.

Although it is described that the start-up indicator signal STI, the reference signal REF, and the output signal OUT are voltage signals, the scope of the present disclosure is not limited to it. In various other embodiments, the start-up indicator signal STI, the reference signal REF, and the output signal OUT may be current signals, without deviating from the scope of the present disclosure. In such a scenario, the comparator 304 may generate the comparison signal CMP such that the comparison signal CMP is at the first logic state when a current level of the reference signal REF is greater than a current level of the start-up indicator signal STI. Further, the comparison signal CMP is at the second logic state when the current level of the reference signal REF is less than or equal to the current level of the start-up indicator signal STI. Alternatively, the comparator 304 may generate the comparison signal CMP such that the comparison signal CMP is at the first logic state when the current level of the reference signal REF is less than or equal to the current level of the start-up indicator signal STI. Further, the comparison signal CMP is at the second logic state when the current level of the reference signal REF is greater than the current level of the start-up indicator signal STI. Additionally, when the output signal OUT is a current signal, the peak controller 310 may control the output signal OUT such that a current level of the output signal OUT is less than the peak limit.

The scope of the present disclosure is further not limited to the first logic state being a logic high state and the second logic state being a logic low state. In an alternate embodiment, the first and second logic states may correspond to a logic low state and a logic high state, respectively, without deviating from the scope of the present disclosure. In such a scenario, the start-up controller 306 is operational when the comparison signal CMP is at a logic low state. Hence, each transistor of the first set of transistors corresponds to a PMOS transistor. Further, the pulse generator 308 may generate the pulse signal PLS when the comparison signal CMP transitions from a logic low state to a logic high state (e.g., during a rising edge of the comparison signal CMP).

The monitoring circuit 312 may be coupled to the power supply 102 and the first logic gate 314. The monitoring circuit 312 may include suitable circuitry to perform one or more operations. In an embodiment, the monitoring circuit 312 may include a first buffer memory (not shown) that may be configured to store the first threshold limit. Further, the monitoring circuit 312 may be configured to receive the first supply voltage VDD and the second supply voltage VSS from the power supply 102. Based on the first and second supply voltages VDD and VSS, the monitoring circuit 312 may be configured to generate a second enable signal EB2. The second enable signal EB2 is activated (e.g., is at a logic high state) when the difference between the first supply voltage VDD and the second supply voltage VSS is greater than or equal to the first threshold limit. Further, the second enable signal is deactivated (e.g., is at a logic low state) when the difference between the first supply voltage VDD and the second supply voltage VSS is less than the first threshold limit. The first threshold limit may be determined based on the type of the self-biased circuit 108.

The first logic gate 314 may be coupled to the toggle circuit 316, the monitoring circuit 312, and the enabling circuit 104. The first logic gate 314 may be configured to receive the first enable signal EB1 and the second enable signal EB2 from the enabling circuit 104 and the monitoring circuit 312, respectively. Further, based on the first and second enable signals EB1 and EB2, the first logic gate 314 may be configured to output a third enable signal EB3 and provide the third enable signal EB3 to the toggle circuit 316. In an embodiment, the first logic gate 314 is a NAND gate. Thus, the third enable signal EB3 is activated (e.g., is at a logic high state) when at least one of the first and second enable signals EB1 and EB2 is deactivated (e.g., is at a logic low state). In other words, the third enable signal EB3 is activated based on deactivation of at least one of the first and second enable signals EB1 and EB2. Further, the third enable signal EB3 is deactivated (e.g., is at a logic low state) when the first and second enable signals EB1 and EB2 are activated (e.g., are at a logic high state). In other words, the third enable signal EB3 is deactivated based on the activation of the first and second enable signals EB1 and EB2.

The toggle circuit 316 may be coupled to the first logic gate 314 and the comparator 304. The toggle circuit 316 may include suitable circuitry to perform one or more operations. For example, the toggle circuit 316 may be configured to receive the comparison signal CMP from the comparator 304 and the third enable signal EB3 from the first logic gate 314. The toggle circuit 316 may be configured to output a second control signal CS2 based on the comparison signal CMP and the third enable signal EB3. In other words, the toggle circuit 316 is controlled based on the third enable signal EB3 and the comparison signal CMP. Further, the third enable signal EB3 is outputted based on the first and second enable signals EB1 and EB2. Thus, the first and second enable signals EB1 and EB2 control the toggle circuit 316. The second control signal CS2 is outputted to activate and deactivate the comparator 304. For example, the comparator 304 is activated and deactivated based on deactivation and activation of the second control signal CS2, respectively.

The second control signal CS2 is deactivated (e.g., is at a logic low state) when the third enable signal EB3 is activated (e.g., is at a logic high state). In other words, the second control signal CS2 is deactivated (e.g., the toggle circuit 316 is reset) based on the activation of the third enable signal EB3. The second control signal CS2 toggles when the third enable signal EB3 is deactivated and the comparison signal CMP transitions from the first logic state to the second logic state (e.g., from a logic high state to a logic low state). In other words, the second control signal CS2 toggles based on the deactivation of the third enable signal EB3 and the transition of the comparison signal CMP from the first logic state to the second logic state.

The toggle circuit 316 may correspond to a toggle flip-flop with a data terminal configured to receive a logic high state signal (not shown), a clock terminal configured to receive the comparison signal CMP, a reset terminal configured to receive the third enable signal EB3, and an output terminal configured to output the second control signal CS2. Alternatively, the toggle circuit 316 may correspond to a D flip-flop with a clock terminal configured to receive the comparison signal CMP, a reset terminal configured to receive the third enable signal EB3, an output terminal configured to output the second control signal CS2, and a data terminal configured to receive an inverted version of the second control signal CS2. The toggle circuit 316 may be implemented by using different circuitries in various other embodiments.

The first delay circuit 318 may be coupled to the toggle circuit 316 and the comparator 304. The first delay circuit 318 may include suitable circuitry to perform one or more operations. For example, the first delay circuit 318 may be configured to receive the second control signal CS2 from the toggle circuit 316. Further, the first delay circuit 318 may be configured to output the first control signal CS1. The first control signal CS1 may be a delayed version of the second control signal CS2. Thus, when the second control signal CS2 transitions from a deactivated state (e.g., a logic low state) to an activated state (e.g., a logic high state), the first control signal CS1 remains at the deactivated state for a third predefined time duration. Further, on the lapse of the third predefined time duration, the first control signal CS1 transitions from the deactivated state to the activated state (e.g., from a logic low state to a logic high state). The first delay circuit 318 may be further configured to provide the first control signal CS1 to the comparator 304. The first control signal CS1 may control the operation of the comparator 304. Although not shown, the first control signal CS1 may further control an operation of the reference signal generator 302 such that the reference signal generator 302 is non-operational when the first control signal CS1 is activated (e.g., is at a logic high state). The delay introduced by the first delay circuit 318 (e.g., the third predefined time duration) ensures that any irregularities in the self-biased circuit 108 do not hamper the start-up of the self-biased circuit 108. In other words, the delay introduced by the first delay circuit 318 ensures that the comparator 304 is not deactivated before the self-biased circuit 108 is successfully started up.

Although FIG. 3 illustrates that the start-up circuit 106 includes the first delay circuit 318, the scope of the present disclosure is not limited to it. In an alternate embodiment, the start-up circuit 106 may be sans the first delay circuit 318, without deviating from the scope of the present disclosure. In such a scenario, the second control signal CS2 may be provided to the comparator 304 for controlling the operation of the comparator 304.

In operation, when the first supply voltage VDD is ramping up, the range of the power supply 102 is less than the first threshold limit. Thus, the second enable signal EB2 is deactivated (e.g., is at a logic low state). As a result, the third enable signal EB3 is activated (e.g., is at a logic high state), thereby resetting the toggle circuit 316. Thus, the second control signal CS2, and in turn, the first control signal CS1 is deactivated. However, as the range of the power supply 102 is less than the first threshold limit, the comparator 304 is non-operational.

When the difference between the first and second supply voltages VDD and VSS is greater than or equal to the first threshold limit, the monitoring circuit 312 activates the second enable signal EB2 (e.g., outputs the second enable signal EB2 at a logic high state). Further, it is assumed that the first enable signal EB1 is activated (e.g., is at a logic high state). Thus, the third enable signal EB3 is deactivated (e.g., is at a logic low state). In such a scenario, the first and second control signals CS1 and CS2 retain a previous logic state. In other words, the first and second control signals CS1 and CS2 remain at a logic low state. Further, as the difference between the first and second supply voltages VDD and VSS is greater than the first threshold limit and the first control signal CS1 is at a logic low state, the comparator 304 is operational. The comparator 304 thus generates the comparison signal CMP at the first logic state (e.g., at a logic high state). The comparison signal CMP at the first logic state indicates that the voltage level of the start-up indicator signal STI is less than the voltage level of the reference signal REF. As the comparison signal CMP is at the first logic state (e.g., is at a logic high state), the start-up controller 306 controls the start-up of the self-biased circuit 108. As a result, the voltage level of the start-up indicator signal STI increases.

When the voltage level of the start-up indicator signal STI is equal to the voltage level of the reference signal REF, the comparison signal CMP transitions from the first logic state to the second logic state (e.g., from a logic high state to a logic low state). In other words, the comparison signal CMP at the second logic state indicates that the voltage level of the start-up indicator signal STI is greater than or equal to the voltage level of the reference signal REF. The transition of the comparison signal CMP is indicative of the successful start-up of the self-biased circuit 108. At such a time instance, the pulse generator 308 generates the pulse signal PLS and provides the pulse signal PLS to the peak controller 310. The peak controller 310 controls, for the second predefined time duration that is equal to the pulse width of the pulse signal PLS, the output signal OUT such that the voltage level of the output signal OUT is below the peak limit on completion of the start-up. The start-up circuit 106 thus starts up the self-biased circuit 108 and prevents overshooting of the output signal OUT.

When the comparison signal CMP transitions from the first logic state to the second logic state (e.g., from a logic high state to a logic low state), the second control signal CS2 is activated (e.g., is at a logic high state). After the activation of the second control signal CS2, the first control signal CS1 remains deactivated (e.g., remains at a logic low state) for the third predefined time duration, and transitions from a deactivated state to an activated state on the lapse of the third predefined time duration. Thus, the comparator 304 remains activated for the third predefined time duration after the self-biased circuit 108 has started up, and is deactivated on the lapse of the third predefined time duration. The start-up circuit 106 is thus deactivated after completion of the start-up of the self-biased circuit 108.

Figure 4:
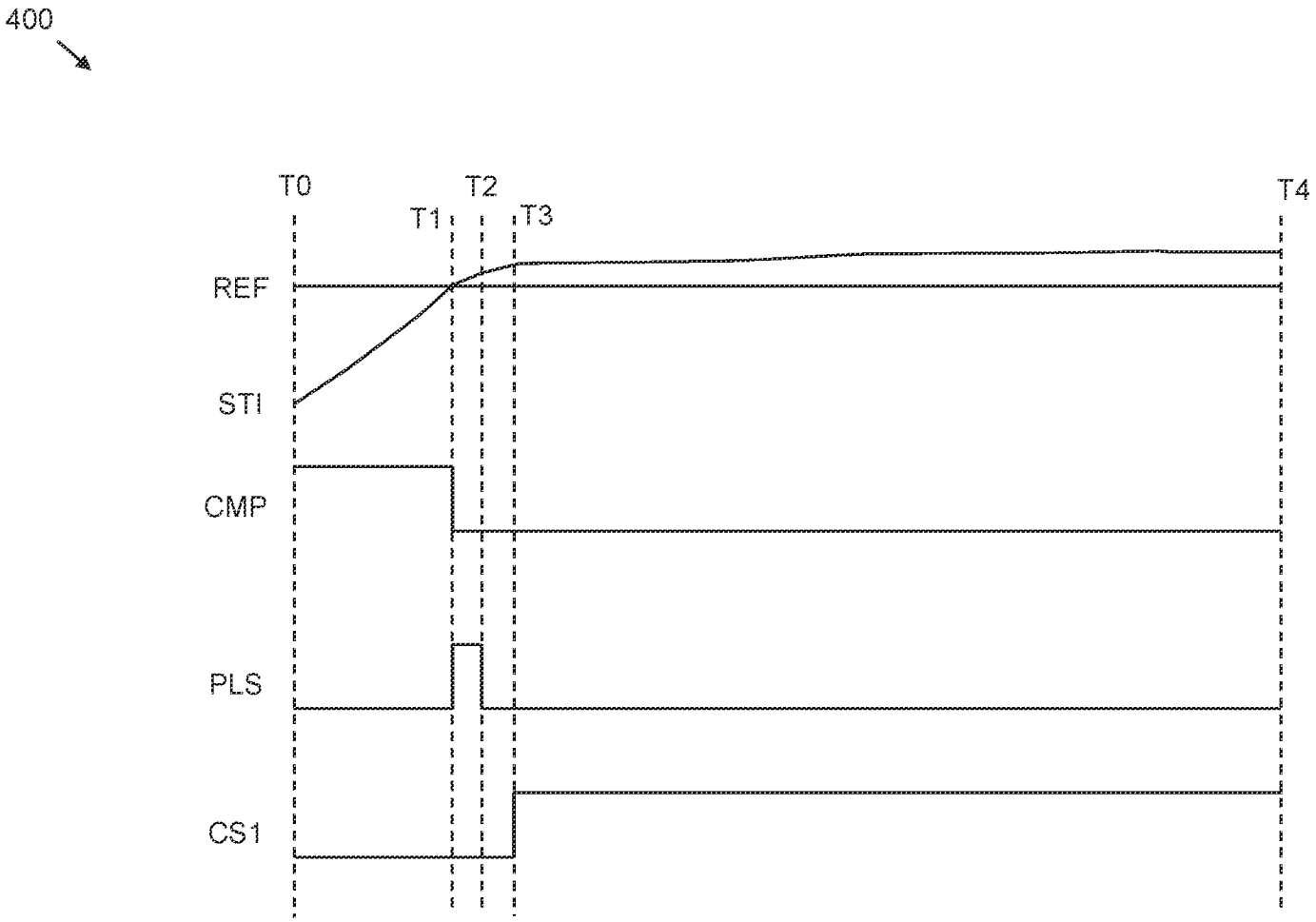
FIG. 4 represents a timing diagram that illustrates an operation of the start-up circuit of FIG. 3 in accordance with an embodiment of the present disclosure.

FIG. 4 represents a timing diagram 400 that illustrates an operation of the start-up circuit 106 in accordance with an embodiment of the present disclosure. The comparator 304 receives the start-up indicator signal STI and the reference signal REF from the self-biased circuit 108 and the reference signal generator 302, respectively. For the sake of ongoing discussion, it is assumed that the first enable signal EB1 is activated (e.g., is at a logic high state) and the difference between the first and second supply voltages VDD and VSS is greater than the first threshold limit.

During a time period T0-T1, the first control signal CS1 is at a logic low state. Thus, the comparator 304 is operational. The voltage level of the start-up indicator signal STI increases during the time-period T0-T1 but is less than the voltage level of the reference signal REF. In other words, the comparison signal CMP is at the first logic state to indicate that the voltage level of the reference signal REF is greater than that of the start-up indicator signal STI. Consequently, the pulse signal PLS is at a logic low state.

At time instance T1, the voltage levels of the start-up indicator signal STI and the reference signal REF are equal. Further, the first control signal CS1 remains at a logic low state. Thus, the comparator 304 is operational and generates the comparison signal CMP such that the comparison signal CMP transitions from a logic high state to a logic low state. In other words, the comparison signal CMP transitions from the first logic state to the second logic state. As a result, the pulse signal PLS transitions from a logic low state to a logic high state. The transition of the comparison signal CMP from a logic high state to a logic low state further results in the transition of the second control signal CS2 from a logic low state to a logic high state.

During a time period T1-T2, the voltage level of the start-up indicator signal STI further increases. Further, the first control signal CS1 remains at a logic low state. Thus, the comparison signal CMP and the pulse signal PLS remain at a logic low state and a logic high state, respectively. The comparison signal CMP is at the second logic state to indicate that the voltage level of the reference signal REF is less than or equal to that of the start-up indicator signal STI.

At time instance T2, the pulse signal PLS transitions from a logic high state to a logic low state. The time period T1-T2 thus corresponds to the pulse width of the pulse signal PLS. In other words, the time period T1-T2 corresponds to the second predefined time duration for which the peak controller 310 controls the output signal OUT. The output signal OUT is controlled such that the voltage level or the current level of the output signal OUT is maintained below the peak limit. The comparison signal CMP and the first control signal CS1 remain at a logic low state.

During a time period T2-T3, the voltage level of the start-up indicator signal STI further increases. The first control signal CS1, the comparison signal CMP, and the pulse signal PLS remain at a logic low state.

At time instance T3, the first control signal CS1 transitions from a logic low state to a logic high state as a result of the transition of the second control signal CS2 from a logic low state to a logic high state at the time instance T1. Thus, a time period T1-T3 corresponds to the third predefined time duration. In other words, the time period T1-T3 corresponds to the delay introduced by the first delay circuit 318. The comparator 304 is thus deactivated. Further, the comparison signal CMP and the pulse signal PLS remain at a logic low state.

During a time period T3-T4, the voltage level of the start-up indicator signal STI further increases before settling to a predetermined value. Further, the first control signal CS1 remains at a logic high state. The comparator 304 thus remains deactivated. Further, the comparison signal CMP and the pulse signal PLS remain at a logic low state. The voltage level of the reference signal REF remains constant during a time period T0-T4.

Figure 5:
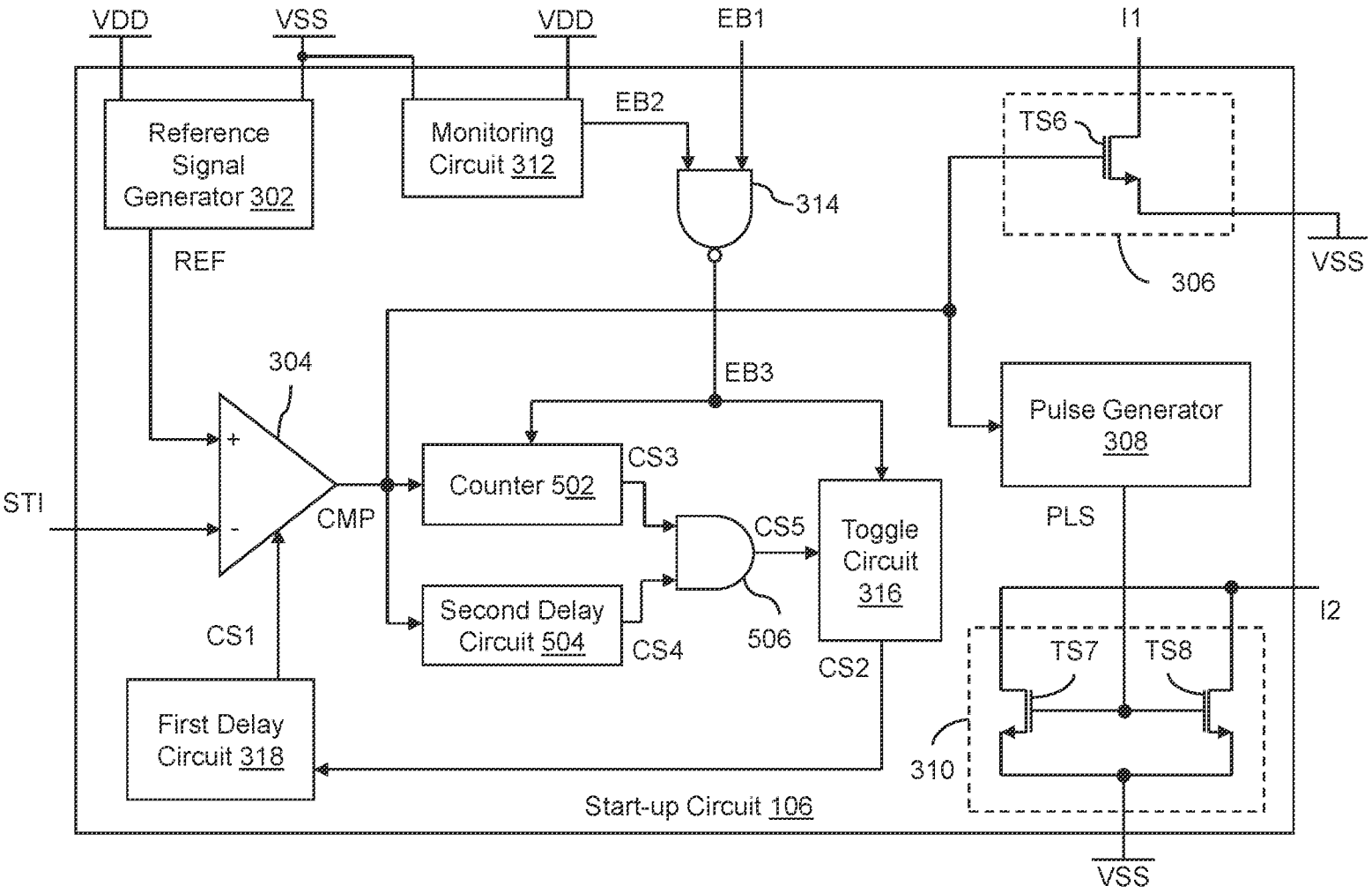
FIG. 5 illustrates a schematic circuit diagram of the start-up circuit of the IC of FIG. 1 in accordance with another embodiment of the present disclosure.

FIG. 5 illustrates a schematic circuit diagram of the start-up circuit 106 in accordance with another embodiment of the present disclosure. The start-up circuit 106 may include the reference signal generator 302, the comparator 304, the start-up controller 306, the pulse generator 308, the peak controller 310, the monitoring circuit 312, the first logic gate 314, the toggle circuit 316, and the first delay circuit 318.

The functionalities of the reference signal generator 302, the comparator 304, the start-up controller 306, the pulse generator 308, the peak controller 310, the monitoring circuit 312, the first logic gate 314, and the first delay circuit 318 remain same as described in FIG. 3. The difference between the start-up circuit 106 of FIG. 5 and the start-up circuit 106 of FIG. 3 is that the start-up circuit 106 of FIG. 5 additionally includes a counter 502, a second delay circuit 504, and a second logic gate 506. The addition of the counter 502, the second delay circuit 504, and the second logic gate 506 in the start-up circuit 106 results in a change in the operation of the toggle circuit 316.

The counter 502 may be coupled to the comparator 304 and the first logic gate 314. The counter 502 may include suitable circuitry to perform one or more operations. For example, the counter 502 may be configured to receive the comparison signal CMP and the third enable signal EB3 from the comparator 304 and the first logic gate 314, respectively. The counter 502 may further be reset by the third enable signal EB3. In an example, when the third enable signal EB3 is activated (e.g., is at a logic high state), the counter 502 is reset. In other words, the counter 502 is reset based on the activation of the third enable signal EB3. Conversely, the counter 502 is operational when the third enable signal EB3 is deactivated (e.g., is at a logic low state).

The counter 502 may be configured to generate a count (not shown) such that the count is incremented at each transition of the comparison signal CMP from the first logic state to the second logic state (e.g., from a logic high state to a logic low state). The counter 502 may be further configured to generate a third control signal CS3. The third control signal CS3 is at the first logic state (e.g., is at a logic high state) when the count is less than a second threshold limit. Further, when the count is equal to the second threshold limit, the third control signal CS3 transitions from the first logic state to the second logic state (e.g., from a logic high state to a logic low state). In an example, the second threshold limit is two. However, the second threshold limit may have other values in other embodiments. In an embodiment, the counter 502 may include a second buffer memory (not shown) that may be configured to store the second threshold limit. The counter 502 may be reset after the third control signal CS3 transitions from the first logic state to the second logic state.

The second delay circuit 504 may be coupled to the comparator 304. The second delay circuit 504 may include suitable circuitry to perform one or more operations. For example, the second delay circuit 504 may be configured to receive the comparison signal CMP from the comparator 304. Further, the second delay circuit 504 may be configured to output a fourth control signal CS4 that is a delayed version of the comparison signal CMP. Thus, when the comparison signal CMP transitions from the first logic state to the second logic state (e.g., from a logic high state to a logic low state), the fourth control signal CS4 remains at the first logic state (e.g., at a logic high state) for a fourth predefined time duration. Further, on the lapse of the fourth predefined time duration, the fourth control signal CS4 transitions from the first logic state to the second logic state (e.g., from a logic high state to a logic low state).

The second logic gate 506 may be coupled to the counter 502 and the second delay circuit 504. The second logic gate 506 may be configured to receive the third control signal CS3 from the counter 502 and the fourth control signal CS4 from the second delay circuit 504. Based on the third and fourth control signals CS3 and CS4, the second logic gate 506 may be further configured to output a fifth control signal CS5. In an embodiment, the second logic gate 506 is an AND gate. Thus, when the third and fourth control signals CS3 and CS4 are at the first logic state (e.g., are at a logic high state), the fifth control signal CS5 is at the first logic state (e.g., is at a logic high state). Further, when at least one of the third and fourth control signals CS3 and CS4 transitions from the first logic state to the second logic state (e.g., from a logic high state to a logic low state), the fifth control signal CS5 transitions from the first logic state to the second logic state. The fifth control signal CS5 is thus derived from the comparison signal CMP. The second logic gate 506 may be further configured to provide the fifth control signal CS5 to the toggle circuit 316.

The scope of the present disclosure is not limited to the first logic state being a logic high state and the second logic state being a logic low state. In an alternate embodiment, the first and second logic states may correspond to a logic low state and a logic high state, respectively, without deviating from the scope of the present disclosure. In such a scenario, the second logic gate 506 may be an OR gate. Further, the third control signal CS3 may be at a logic low state when the count is less than the second threshold limit, and transitions from a logic low state to a logic high state when the count is equal to the second threshold limit.

The toggle circuit 316 may be coupled to the first logic gate 314 and the second logic gate 506. The toggle circuit 316 may include suitable circuitry to perform one or more operations. For example, the toggle circuit 316 may be configured to receive the fifth control signal CS5 from the second logic gate 506 and the third enable signal EB3 from the first logic gate 314. The toggle circuit 316 may be configured to output the second control signal CS2 based on the fifth control signal CS5 and the third enable signal EB3. The second control signal CS2 is deactivated (e.g., is at a logic low state) when the third enable signal EB3 is activated. In other words, the second control signal CS2 is deactivated (e.g., is at a logic low state) based on the activation of the third enable signal EB3. Further, the second control signal CS2 toggles (e.g., is at a logic high state) when the third enable signal EB3 is deactivated and the fifth control signal CS5 transitions from the first logic state to the second logic state (e.g., from a logic high state to a logic low state). In other words, the second control signal CS2 toggles based on the deactivation of the third enable signal EB3 and the transition of the fifth control signal CS5 from the first logic state to the second logic state.

The fifth control signal CS5 may transition from the first logic state to the second logic state based on the transition of the comparison signal CMP from the first logic state to the second logic state for a predefined number of times (e.g., the second threshold limit). In other words, the fifth control signal CS5 may transition from the first logic state to the second logic state when the count is equal to the second threshold limit. Alternatively, the fifth control signal CS5 may transition from the first logic state to the second logic state based on the lapse of the fourth predefined time duration after the transition of the comparison signal CMP from the first logic state to the second logic state.

The start-up indicator signal STI may experience ringing before attaining a stable state during the start-up. The ringing may arise as a result of various components included in a loop, formed between the start-up circuit 106 and the self-biased circuit 108, having different time constants. The ringing may falsely trigger the transition of the comparison signal CMP, which may deactivate the comparator 304 before the self-biased circuit 108 has started up. Thus, the counter 502 ensures that the comparator 304 is not deactivated immediately after one transition of the comparison signal CMP from the first logic state to the second logic state. In other words, the counter 502 ensures that the comparator 304 is deactivated after the comparison signal CMP transitions for the predefined number of times that is equal to the second threshold limit. Further, the second delay circuit 504 ensures even if the comparison signal CMP does not transition for the predefined number of times, the second control signal CS2 is activated based on an initial transition of the comparison signal CMP.

The start-up circuit 106 includes various components, such as the start-up controller 306, the pulse generator 308, the peak controller 310, the first logic gate 314, the counter 502, the second logic gate 506, and the toggle circuit 316 that are digital. Additionally, various signals generated in the start-up circuit 106, such as the comparison signal CMP, the second and third enable signals EB2 and EB3, the second control signal CS2, and the pulse signal PLS, are also digital. The start-up circuit 106 of the present disclosure is thus digitally-assisted. In other words, the start-up circuit 106 is also referred to as a "digitally-assisted start-up circuit 106".

Figure 6:
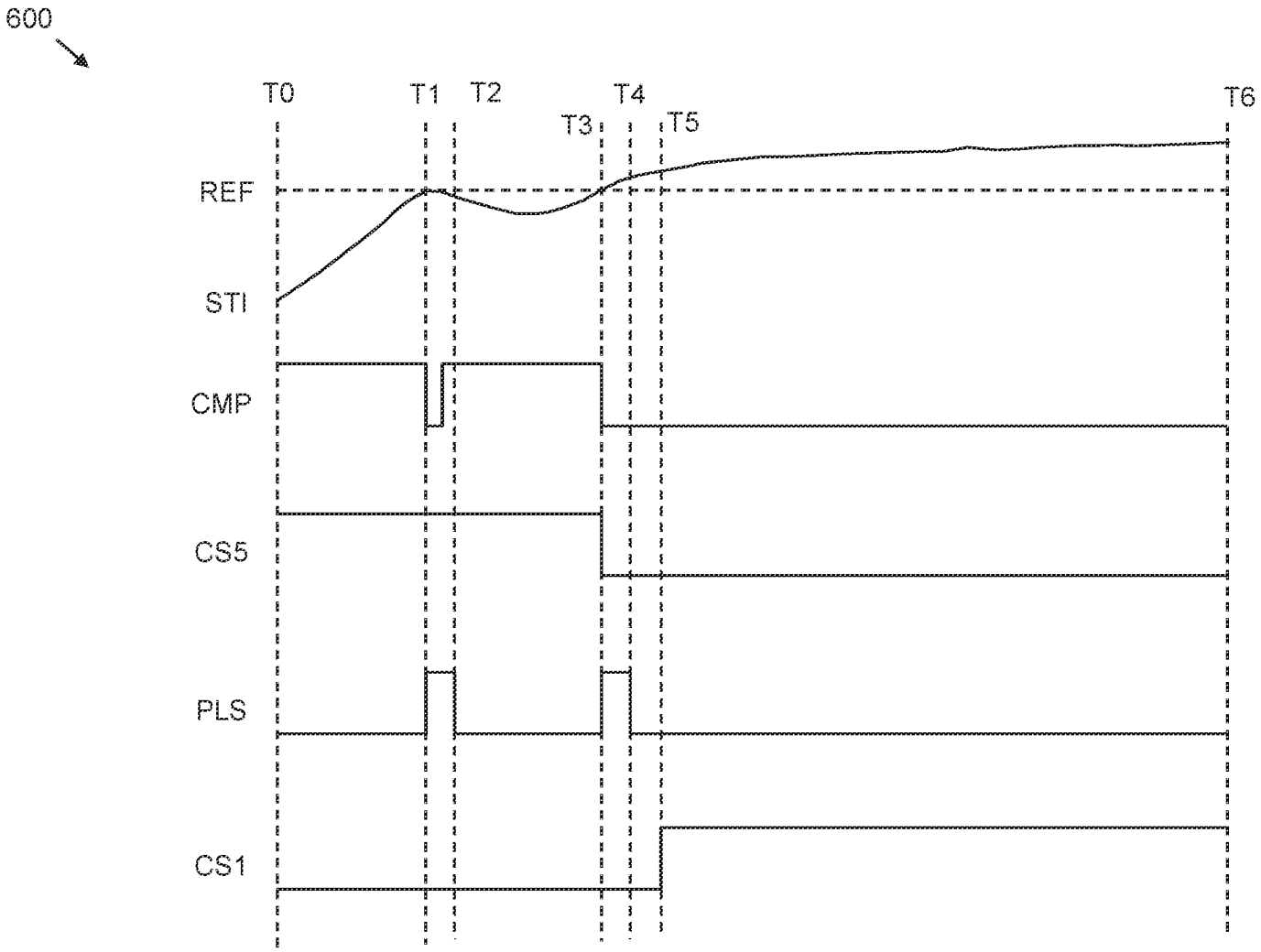
FIG. 6 represents a timing diagram that illustrates an operation of the start-up circuit of FIG. 5 in accordance with another embodiment of the present disclosure.

FIG. 6 represents a timing diagram 600 that illustrates the operation of the start-up circuit 106 in accordance with another embodiment of the present disclosure. The comparator 304 receives the start-up indicator signal STI and the reference signal REF from the self-biased circuit 108 and the reference signal generator 302, respectively. For the sake of ongoing discussion, it is assumed that the first enable signal EB1 is activated (e.g., is at a logic high state) and the difference between the first and second supply voltages VDD and VSS is greater than the first threshold limit.

During a time period T0-T1, the first control signal CS1 is at a logic low state. Thus, the comparator 304 is operational. The voltage level of the start-up indicator signal STI increases during the time-period T0-T1 but is less than the voltage level of the reference signal REF. Thus, the comparison signal CMP is at a logic high state. In other words, the comparison signal CMP is at the first logic state. Consequently, the pulse signal PLS is at a logic low state. Further, the fifth control signal CS5 is at a logic high state. In other words, the fifth control signal CS5 is at the first logic state.

At time instance T1, the voltage levels of the start-up indicator signal STI and the reference signal REF are equal.

Further, the first control signal CS1 remains at a logic low state. Thus, the comparator 304 is operational and generates the comparison signal CMP such that the comparison signal CMP transitions from a logic high state to a logic low state. In other words, the comparison signal CMP transitions from the first logic state to the second logic state. As a result, the pulse signal PLS transitions from a logic low state to a logic high state. The transition of the comparison signal CMP from a logic high state to a logic low state further results in the incrementation of the count such that the count is equal to one. For the sake of ongoing discussion, it is assumed that the second threshold limit is two. Thus, the third control signal CS3, and in turn, the fifth control signal CS5 remains at a logic high state.

During a time period T1-T2, the voltage level of the start-up indicator signal STI decreases. In other words, the start-up indicator signal STI experiences ringing. Further, the first control signal CS1 remains at a logic low state. Thus, the comparison signal CMP toggles from a logic low state to a logic high state. Further, the pulse signal PLS and the fifth control signal CS5 remain at a logic high state.

At time instance T2, the pulse signal PLS transitions from a logic high state to a logic low state. The time period T1-T2 thus corresponds to the pulse width of the pulse signal PLS. In other words, the time period T1-T2 corresponds to the second predefined time duration for which the peak controller 310 controls the output signal OUT. The output signal OUT is controlled such that the voltage level or the current level of the output signal OUT is less than the peak limit. The comparison signal CMP and the fifth control signal CS5 remain at a logic high state, and the first control signal CS1 remains at a logic low state.

During a time period T2-T3, the first control signal CS1 is at a logic low state. The voltage level of the start-up indicator signal STI is less than the voltage level of the reference signal REF. Thus, the comparison signal CMP is at a logic high state. Further, the pulse signal PLS is at a logic low state and the fifth control signal CS5 is at a logic high state.

At time instance T3, the voltage levels of the start-up indicator signal STI and the reference signal REF are equal. Further, the first control signal CS1 remains at a logic low state. Thus, the comparison signal CMP transitions from a logic high state to a logic low state. As a result, the pulse signal PLS transitions from a logic low state to a logic high state. Further, the transition of the comparison signal CMP from a logic high state to a logic low state results in the incrementation of the count such that the count is equal to two. Thus, the third control signal CS3, and in turn, the fifth control signal CS5 transitions from a logic high state to a logic low state. In other words, the fifth control signal CS5 transitions from the first logic state to the second logic state. The transition of the fifth control signal CS5 from a logic high state to a logic low state results in the transition of the second control signal CS2 from a logic low state to a logic high state.

During a time period T3-T4, the voltage level of the start-up indicator signal STI further increases. Thus, the comparison signal CMP and the fifth control signal CS5 remain at a logic low state. Further, the pulse signal PLS and the first control signal CS1 remain at a logic high state and a logic low state, respectively.

At time instance T4, the pulse signal PLS transitions from a logic high state to a logic low state. The time period T3-T4 thus corresponds to the pulse width of the pulse signal PLS. In other words, the time period T3-T4 corresponds to the second predefined time duration for which the peak controller 310 controls the output signal OUT. The comparison signal CMP, the fifth control signal CS5, and the first control signal CS1 remain at a logic low state.

During a time period T4-T5, the voltage level of the start-up indicator signal STI further increases. Further, the first control signal CS1 remains at a logic low state. The comparator 304 thus remains activated. The comparison signal CMP, the fifth control signal CS5, and the pulse signal PLS remain at a logic low state.

At time instance T5, the first control signal CS1 transitions from a logic low state to a logic high state as a result of the transition of the second control signal CS2 from a logic low state to a logic high state at time instance T3. Thus, a time period T3-T5 corresponds to the third predefined time duration. In other words, the time period T3-T5 corresponds to the delay introduced by the first delay circuit 318. The comparator 304 is thus deactivated. Further, the comparison signal CMP, the fifth control signal CS5, and the pulse signal PLS remain at a logic low state.

During a time period T5-T6, the voltage level of the start-up indicator signal STI further increases before settling to the predetermined value. Further, the first control signal CS1 remains at a logic high state. The comparator 304 thus remains deactivated. Further, the comparison signal CMP, the fifth control signal CS5, and the pulse signal PLS remain at a logic low state. The voltage level of the reference signal REF remains constant during a time period T0-T6.

The utilization of the counter 502 for adjusting ringing in the start-up indicator signal STI is illustrated above in FIG. 6. If the voltage level of the start-up indicator signal STI does not experience ringing, the transition of the comparison signal CMP at time instance T1 results in the transition of the fourth control signal CS4 after the fourth predefined time duration. Consequently, the fifth control signal CS5 transitions from a logic high state to a logic low state to facilitate the deactivation of the comparator 304.

Figure 7:
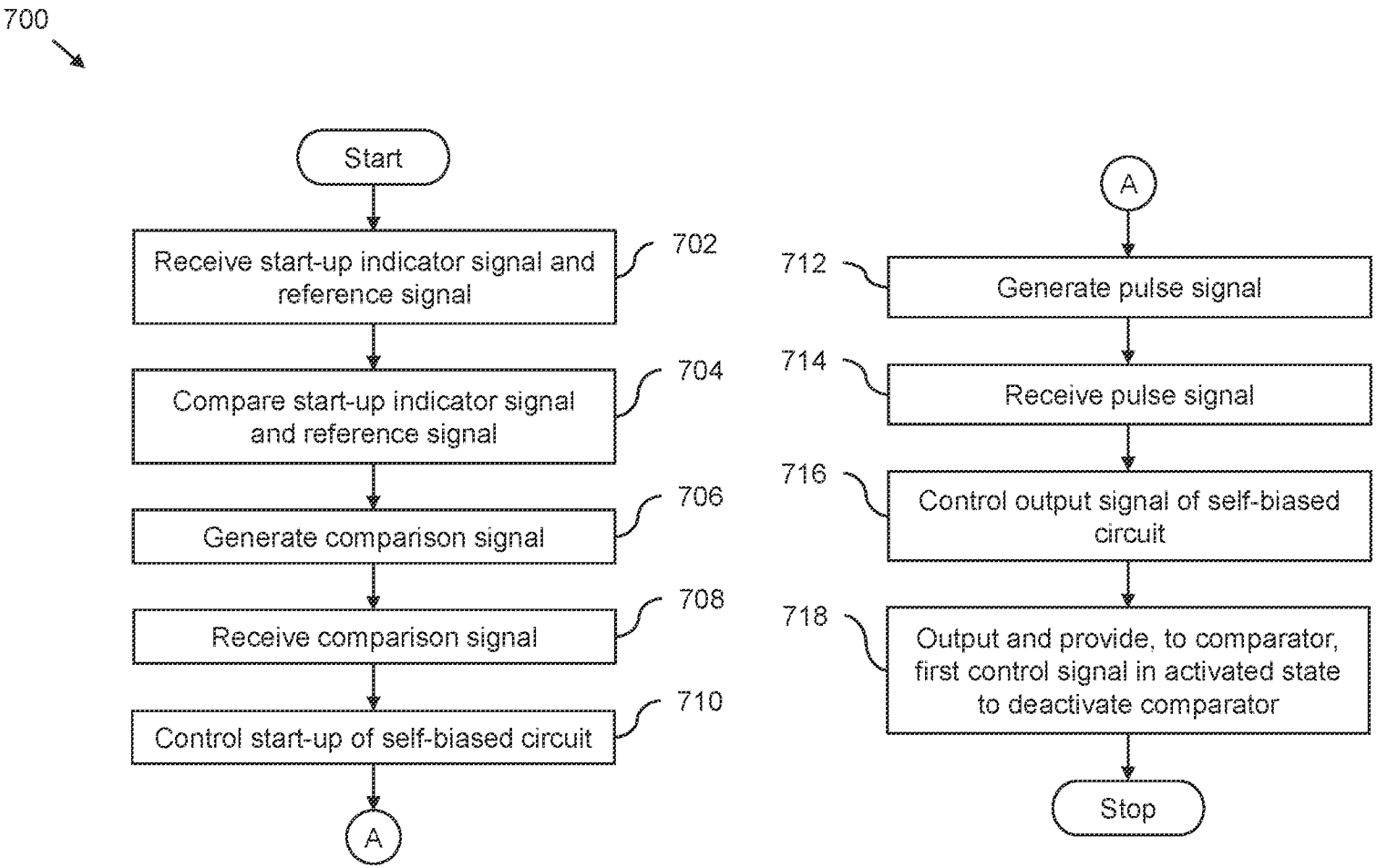
FIG. 7 represents a flowchart that illustrates a start-up method for the self-biased circuit of the IC of FIG. 1 in accordance with an embodiment of the present disclosure.

FIG. 7 represents a flowchart 700 that illustrates a start-up method for the self-biased circuit 108 in accordance with an embodiment of the present disclosure. At step 702, the comparator 304 may receive the start-up indicator signal STI from the self-biased circuit 108 and the reference signal REF from the reference signal generator 302. At step 704, the comparator 304 may compare the start-up indicator signal STI and the reference signal REF. At step 706, the comparator 304 may generate the comparison signal CMP based on the comparison of the start-up indicator signal STI with the reference signal REF. For the sake of ongoing discussion, it is assumed that the voltage level of the start-up indicator signal STI is less than the voltage level of the reference signal REF. Thus, the comparison signal CMP is at the first logic state (e.g., is at a logic high state).

At step 708, the start-up controller 306 and the pulse generator 308 may receive the comparison signal CMP from the comparator 304. At step 710, the start-up controller 306 may control the start-up of the self-biased circuit 108. The start-up controller 306 may control the start-up of the self-biased circuit 108 when the comparison signal CMP is at the first logic state (e.g., is at a logic high state). As a result, the voltage level of the start-up indicator signal STI increases. The comparison signal CMP transitions from the first logic state to the second logic state (e.g., from a logic high state to a logic low state) when the voltage levels of the start-up indicator signal STI and the reference signal REF are equal.

At step 712, the pulse generator 308 may generate the pulse signal PLS having the predefined pulse width when the comparison signal CMP transitions from the first logic state to the second logic state (e.g., from a logic high state to a logic low state). At step 714, the peak controller 310 may receive the pulse signal PLS from the pulse generator 308. At step 716, the peak controller 310 may control the output signal OUT of the self-biased circuit 108. The peak controller 310 may control the output signal OUT to maintain at least one of the voltage level and the current level of the output signal OUT below the peak limit. The output signal OUT is controlled for the second predefined time duration that is equal to the pulse width of the pulse signal PLS.

At step 718, the first delay circuit 318 may output and provide, to the comparator 304, the first control signal CS1 in an activated state to deactivate the comparator 304. The first control signal CS1 is activated on the lapse of the third predefined time duration after the activation of the second control signal CS2. The second control signal CS2 may be activated immediately after the comparison signal CMP transitions from the first logic state to the second logic state or on the lapse of the fourth predefined time duration after the transition of the comparison signal CMP from the first logic state to the second logic state. Alternatively, the second control signal CS2 may be activated when the comparison signal CMP transitions from the first logic state to the second logic state for the predefined number of times. Thus, the start-up circuit 106 is deactivated after the completion of the start-up of the self-biased circuit 108.

Thus, the start-up circuit 106 of the present disclosure facilitates the start-up of the self-biased circuit 108, thereby preventing an operational failure of the IC 100. Some conventional start-up circuits include exclusively analog components that render such conventional start-up circuits sensitive to supply and temperature variations in an IC. As a result, some conventional start-up circuits need to be modified if there is a change in any of these parameters. The analog nature of some conventional start-up circuits further makes it difficult to exhaustively verify such conventional start-up circuits. The reliability of some conventional start-up circuits thus significantly degrades. The digitally-assisted start-up circuit 106 of some embodiments of the present disclosure is significantly less sensitive to the supply and temperature variations in the IC 100 as compared to some conventional start-up circuits. Thus, the supply and temperature variations in the IC 100 do not result in significant modifications in the start-up circuit 106. Hence, a need to verify the start-up circuit 106 for any supply and temperature variations in the IC 100 is eliminated. As a result, the reliability of the start-up circuit 106 of some embodiments of the present disclosure is significantly higher than that of some conventional start-up circuits.

Some conventional start-up circuits have issues due to overshooting of output signals of self-biased circuits on completion of the start-up of the self-biased circuits. The start-up circuit 106 of some embodiments of the present disclosure controls the start-up of the self-biased circuit 108 and further controls the output signal OUT on completion of the start-up. As a result, the voltage level or the current level of the output signal OUT is maintained below the peak limit on completion of the start-up. Thus, overshooting of the output signal OUT is prevented, thereby preventing damages to the functional circuit 110.

While various embodiments of the present disclosure have been illustrated and described, it will be clear that the present disclosure is not limited to these embodiments only. Numerous modifications, changes, variations, substitutions, and equivalents will be apparent to those skilled in the art, without departing from the spirit and scope of the present disclosure, as described in the claims. Further, unless stated otherwise, terms such as "first" and "second" are used to arbitrarily distinguish between the elements such terms describe. Thus, these terms are not necessarily intended to indicate temporal or other prioritization of such elements.

The invention claimed is:

1. A circuit, comprising:

a self-biased circuit configured to generate (i) a start-up indicator signal that indicates whether the self-biased circuit has started up and (ii) an output signal; and a start-up circuit coupled to the self-biased circuit, wherein the start-up circuit comprises:

a comparator configured to compare the start-up indicator signal with a reference signal and generate a comparison signal based on the comparison of the start-up indicator signal with the reference signal, wherein the reference signal is generated based on a first supply voltage and a second supply voltage of the start-up circuit;

a start-up controller configured to control a start-up of the self-biased circuit when the comparison signal is at a first logic state; and a peak controller configured to control the output signal to maintain at least one of a group consisting of a voltage level and a current level of the output signal below a peak limit, wherein the peak controller controls the output signal when the comparison signal transitions from the first logic state to a second logic state.

2. The circuit of claim 1, wherein the start-up circuit further comprises a pulse generator that is coupled to the comparator and the peak controller, and configured to receive the comparison signal, generate a pulse signal when the comparison signal transitions from the first logic state to the second logic state, and provide the pulse signal to the peak controller, and wherein the peak controller controls the output signal based on the pulse signal.

3. The circuit of claim 2, wherein the peak controller comprises a set of transistors, wherein to control the output signal, the set of transistors is configured to pull down the output signal to the second supply voltage for a predefined time duration that is equal to a pulse width of the pulse signal, and wherein the second supply voltage is less than the first supply voltage.

4. The circuit of claim 1, wherein the start-up circuit further comprises a reference signal generator that is coupled to the comparator, and configured to (i) receive the first and second supply voltages, (ii) generate the reference signal that has a voltage level less than a difference between the first and second supply voltages, and (iii) provide the reference signal to the comparator for the comparison with the start-up indicator signal.

5. The circuit of claim 1, wherein the start-up circuit further comprises a toggle circuit that is configured to output, based on a first enable signal and the comparison signal, a control signal to activate and deactivate the comparator, and wherein the comparator is activated and deactivated based on deactivation and activation of the control signal, respectively.

6. The circuit of claim 5, wherein the control signal is deactivated based on activation of the first enable signal, and wherein the control signal toggles based on (i) deactivation of the first enable signal and (ii) the transition of the comparison signal from the first logic state to the second logic state.

7. The circuit of claim 5, wherein the control signal is deactivated based on activation of the first enable signal, and wherein the control signal toggles based on (i) deactivation of the first enable signal and (ii) the transition of the comparison signal from the first logic state to the second logic state for a predefined number of times.

8. The circuit of claim 7, wherein the start-up circuit further comprises a counter that is coupled to the comparator, and configured to:

receive the comparison signal and the first enable signal, wherein the counter is reset based on the activation of the first enable signal; and generate a count that is incremented at each transition of the comparison signal from the first logic state to the second logic state, wherein the count being equal to a threshold limit indicates that the comparison signal has transitioned from the first logic state to the second logic state for the predefined number of times.

9. The circuit of claim 5, wherein the control signal is deactivated based on activation of the first enable signal, and wherein the control signal toggles based on (i) deactivation of the first enable signal and (ii) lapse of a predefined time duration after the transition of the comparison signal from the first logic state to the second logic state.

10. The circuit of claim 5, wherein the start-up circuit further comprises a monitoring circuit configured to receive the first and second supply voltages and generate a second enable signal to control the toggle circuit, and wherein the toggle circuit is reset based on deactivation of the second enable signal.

11. The circuit of claim 10, wherein the second enable signal is activated when a difference between the first supply voltage and the second supply voltage is greater than or equal to a threshold limit, and wherein the second enable signal is deactivated when the difference between the first supply voltage and the second supply voltage is less than the threshold limit.

12. The circuit of claim 10, wherein the start-up circuit further comprises a logic gate that is coupled to the monitoring circuit, and configured to receive the second enable signal and a third enable signal, and output the first enable signal, wherein an operation of the start-up circuit is controlled based on the third enable signal, and wherein the first enable signal is activated based on deactivation of at least one of a group consisting of the second enable signal and the third enable signal, and the first enable signal is deactivated based on activation of the second enable signal and the third enable signal.

13. The circuit of claim 5, wherein the start-up circuit further comprises a delay circuit that is coupled to the toggle circuit and the comparator, and configured to receive the control signal, output a delayed version of the control signal, and provide the delayed version of the control signal to the comparator to control the comparator.

14. The circuit of claim 1, wherein to control the start-up of the self-biased circuit, the start-up controller is further configured to source a current to the self-biased circuit when the comparison signal is at the first logic state.

15. The circuit of claim 1, wherein to control the start-up of the self-biased circuit, the start-up controller is further configured to sink a current from the self-biased circuit when the comparison signal is at the first logic state.

16. The circuit of claim 1, wherein the self-biased circuit comprises one of a group consisting of: a current reference circuit, a voltage reference circuit, and a self-referenced voltage regulator.

17. The circuit of claim 1, wherein the start-up indicator signal is same as the output signal.

18. The circuit of claim 1, wherein the comparison signal at the first logic state indicates that one of a group consisting of a voltage level and a current level of the reference signal is greater than that of the start-up indicator signal, and wherein the comparison signal at the second logic state indicates that one of a group consisting of the voltage level and the current level of the reference signal is less than or equal to that of the start-up indicator signal.

19. The circuit of claim 1, wherein the comparison signal at the first logic state indicates that one of a group consisting of a voltage level and a current level of the reference signal is less than or equal to that of the start-up indicator signal, and wherein the comparison signal at the second logic state indicates that one of a group consisting of the voltage level and the current level of the reference signal is greater than that of the start-up indicator signal.

20. A start-up method for a self-biased circuit, the start-up method comprising:

comparing, by a comparator of a start-up circuit, a start-up indicator signal with a reference signal, wherein the start-up indicator signal indicates whether the self-biased circuit has started up, and wherein the reference signal is generated based on a first supply voltage and a second supply voltage of the start-up circuit;

generating, by the comparator, a comparison signal based on the comparison of the start-up indicator signal with the reference signal;

controlling, by a start-up controller of the start-up circuit, a start-up of the self-biased circuit when the comparison signal is at a first logic state; and controlling, by a peak controller of the start-up circuit, an output signal of the self-biased circuit to maintain at least one of a group consisting of a voltage level and a current level of the output signal below a peak limit, wherein the output signal is controlled when the comparison signal transitions from the first logic state to a second logic state.

* * * * *